US010787870B1

(12) United States Patent
Fulks et al.

(10) Patent No.: US 10,787,870 B1
(45) Date of Patent: Sep. 29, 2020

(54) JOINTED PIPE INJECTOR

(71) Applicant: CONSOLIDATED RIG WORKS L.P., Fort Worth, TX (US)

(72) Inventors: Caleb E. M. Fulks, McKinney, TX (US); Rick P. Coon, Arlington, TX (US); Kenneth D. Butler, Aledo, TX (US)

(73) Assignee: CONSOLIDATED RIG WORKS L.P., Fort Worth, TX (US)

( * ) Notice: Subject to any disclaimer, the term of this patent is extended or adjusted under 35 U.S.C. 154(b) by 258 days.

(21) Appl. No.: 15/891,063

(22) Filed: Feb. 7, 2018

(51) Int. Cl.

| | |
|---|---|
| ***E21B 19/22*** | (2006.01) |
| ***E21B 19/08*** | (2006.01) |
| ***E21B 19/081*** | (2006.01) |
| ***E21B 19/084*** | (2006.01) |
| ***E21B 19/083*** | (2006.01) |
| *E21B 19/24* | (2006.01) |

(52) U.S. Cl.
CPC ..... *E21B 19/22* (2013.01); *E21B 19/08* (2013.01); *E21B 19/081* (2013.01); *E21B 19/083* (2013.01); *E21B 19/084* (2013.01); *E21B 19/24* (2013.01)

(58) Field of Classification Search
CPC ..... E21B 19/08; E21B 19/084; E21B 19/081; E21B 19/083; E21B 19/22; B66D 3/003
See application file for complete search history.

(56) References Cited

U.S. PATENT DOCUMENTS

| | | | |
|---|---|---|---|
| 2,567,009 | A | 9/1951 | Calhoun et al. |
| 3,182,877 | A | 5/1965 | Slator |
| 3,285,485 | A | 11/1966 | Slator |
| 3,313,346 | A | 4/1967 | Cross |
| 3,317,103 | A | 5/1967 | Cullen et al. |
| 3,615,154 | A | 10/1971 | Pryor |
| 3,724,567 | A | 4/1973 | Smitherman |
| 4,336,901 | A | 6/1982 | Gray |
| 4,585,061 | A | 4/1986 | Lyons et al. |
| 4,655,291 | A | 4/1987 | Cox |
| 4,735,270 | A | 4/1988 | Fenyvesi |
| 4,899,823 | A | 2/1990 | Cobb et al. |
| 4,940,095 | A | 7/1990 | Newman |

(Continued)

FOREIGN PATENT DOCUMENTS

| | | |
|---|---|---|
| AU | 2006316335 | 12/2011 |
| AU | 2007306067 | 12/2012 |

(Continued)

*Primary Examiner* — Tara Schimpf

(57) ABSTRACT

A joined pipe injector for the oil-field industry that is capable of handling strings of jointed pipe. The injector includes gripper block assemblies removably mounted to a pair of looping, sprocket-supported drive chains facing a pipe/tubing passage therebetween. The gripper block assemblies have self-adjusting pipe inserts biased with springs to grip tubing or pipe of constant nominal diameter or pipe having both nominal and secondary diameter including upset joints. An insert guide is provided at the end of the pipe/tubing passage to postpone contact between the pipe inserts and the pipe when the respective gripper block assemblies are moving with curving motion around the sprockets. The injector is designed to operate either independently, or in conjunction with a conventional work-over and/or drill rig.

17 Claims, 11 Drawing Sheets

(56) References Cited

U.S. PATENT DOCUMENTS

| | | | | |
|---|---|---|---|---|
| 5,133,405 | A | 7/1992 | Elliston | |
| 5,188,174 | A | 2/1993 | Anderson | |
| 5,309,990 | A | 5/1994 | Lance | |
| 5,553,668 | A | 9/1996 | Council et al. | |
| 5,566,764 | A | 10/1996 | Elliston | |
| 5,765,643 | A | 6/1998 | Shaaban et al. | |
| 5,775,417 | A | 7/1998 | Council et al. | |
| 5,803,168 | A | 9/1998 | Lormand et al. | |
| 5,845,708 | A | 12/1998 | Burge et al. | |
| 5,890,534 | A | 4/1999 | Burge et al. | |
| 5,918,671 | A | 7/1999 | Bridges et al. | |
| 5,937,943 | A | 8/1999 | Butler | |
| 5,975,203 | A * | 11/1999 | Payne | E21B 19/22 166/77.1 |
| 6,135,202 | A | 10/2000 | Koshak | |
| 6,173,769 | B1 | 1/2001 | Goode | |
| 6,209,634 | B1 | 4/2001 | Avakov et al. | |
| 6,216,780 | B1 | 4/2001 | Goode et al. | |
| 6,347,664 | B1 * | 2/2002 | Perio, Jr. | E21B 19/22 166/77.3 |
| 6,367,557 | B1 | 4/2002 | Rosine | |
| 6,412,560 | B1 | 7/2002 | Bernat | |
| 6,516,891 | B1 | 2/2003 | Dallas | |
| 6,609,566 | B2 | 8/2003 | Perio | |
| 6,892,810 | B2 | 5/2005 | Austbo et al. | |
| 7,051,814 | B2 | 5/2006 | Goode et al. | |
| 7,124,815 | B2 | 10/2006 | Rosine et al. | |
| 7,708,058 | B1 | 5/2010 | Gipson | |
| 7,857,042 | B2 | 12/2010 | Koopmans et al. | |
| 8,701,754 | B2 | 4/2014 | McCulloch | |
| 9,493,997 | B2 | 11/2016 | Liu et al. | |
| 2003/0209346 | A1 | 11/2003 | Austbo et al. | |
| 2004/0020661 | A1 | 2/2004 | Simpson et al. | |
| 2004/0188100 | A1 * | 9/2004 | Austbo | E21B 19/22 166/384 |
| 2004/0211555 | A1 | 10/2004 | Austbo et al. | |
| 2005/0205267 | A1 | 9/2005 | Dallas | |
| 2005/0247454 | A1 | 11/2005 | Domann | |
| 2006/0081368 | A1 | 4/2006 | Rosine | |
| 2008/0296013 | A1 | 12/2008 | Pleskie | |
| 2010/0071334 | A1 | 3/2010 | Owen | |
| 2010/0108329 | A1 | 5/2010 | Kotsonis et al. | |
| 2012/0073833 | A1 | 3/2012 | McCulloch | |
| 2012/0085553 | A1 | 4/2012 | Shampine | |
| 2012/0247787 | A1 | 10/2012 | Lancaster | |
| 2013/0056224 | A1 | 3/2013 | Angelle et al. | |
| 2013/0112433 | A1 | 5/2013 | Armstrong | |
| 2013/0333900 | A1 | 12/2013 | McCulloch | |
| 2014/0251637 | A1 * | 9/2014 | Gubbins | E21B 19/22 166/381 |

FOREIGN PATENT DOCUMENTS

| | | |
|---|---|---|
| CA | 2797911 | 2/2002 |
| CA | 2335678 | 10/2004 |
| CA | 2461977 | 9/2005 |
| CA | 2506405 | 1/2008 |
| CA | 2506396 | 7/2008 |
| CA | 2530076 | 8/2010 |
| CA | 2414882 | 12/2010 |
| CA | 2699906 | 2/2011 |
| CA | 2791852 | 9/2011 |
| CA | 2812220 | 3/2012 |
| CN | 201297134 | 8/2009 |
| CN | 2012971414 | 8/2009 |
| CN | 102155172 | 8/2011 |
| CN | 202578585 | 12/2012 |
| EP | 1090206 | 4/2001 |
| FR | 1461032 | 2/1967 |
| FR | 2062936 | 7/1971 |
| GB | 1402076 | 8/1975 |
| GB | 2326178 | 12/1998 |
| GB | 2358654 | 4/2004 |
| WO | WO9927223 | 6/1999 |
| WO | WO0017481 | 3/2000 |
| WO | WO0157355 | 11/2001 |
| WO | WO2011146623 | 11/2011 |
| WO | Wo2011126377 | 6/2012 |
| WO | WO2013033568 | 3/2013 |

* cited by examiner

JOINTED PIPE INJECTOR

TECHNICAL FIELD

This invention pertains to work-over related oil-field work, for example maintaining productions strings in pressurized oil wells. More specifically, the invention relates to a jointed pipe injector configured to support and move pipe and tubing, including jointed pipe, into and out of a well bore, which well bore may be pressurized or unpressurized. The injector of the current invention may operate either independently, or in conjunction with a conventional work-over and/or drill rig.

BACKGROUND

There are many known devices for injecting coiled tubing into a well bore. However, conventional coiled tubing injectors are not capable of handling jointed pipe. Injectors offer safety and speed advancements over the conventional methods of working with jointed pipe. A need therefore exists, for an injector capable of handling jointed pipe.

Further, conventional tubing injectors may use non-standard drive chains in which portions of the gripper block assemblies are integral parts of the chain itself. The use of non-standard drive chains may result in higher costs of acquisition, maintenance and/or operation. A need therefore exists, for an injector that uses standard roller chains to which the gripper block assemblies are removably attached.

SUMMARY

The present invention comprises a joined pipe injector apparatus that is capable of handling strings of jointed pipe in addition to other tubular goods including coiled tubing. A self-adjusting gripper block system allows for upset tubing joints to be passed through the unit without operator intervention. The gripper block assemblies can be interleaved, forming a continuous surface, to easily convey over the skate rollers during operation. The gripper blocks can bolt directly to standard chain, thus eliminating the need to build a custom chain to integrate the gripper blocks. A telescopic torque tube system can be used to mechanically time both drive chain systems.

In one aspect, a jointed pipe injector is provided that is capable of handling strings of jointed pipe that may or may not have upset joints resulting in localized variations in the diameter of the pipe along the string. The jointed pipe injector comprises a pair of endless drive chains, each drive chain configured in a loop and including a plurality of gripper blocks attached to the outward-facing side of the loop. The two drive chains are arranged with a portion of each loop running substantially parallel to the other and synchronized such that each gripper block on one chain faces a corresponding gripper block on the other chain. The opposing gripper blocks and piper inserts define a pipe passage therebetween. A self-adjusting gripper block system provides localized gripper compliance whereby the distance between opposing gripper blocks on the two drive chains in a first pair of gripper blocks can be different from the distance between opposing gripper blocks in a successive pair of gripper blocks.

In another aspect, a joined pipe injector is provided for injecting and withdrawing a length of pipe or tubing having a nominal diameter from a wellbore. The joined pipe injector comprises a pair of drive chains, each drive chain configured in an endless loop defining an outward-facing side and including a substantially straight portion, and wherein the outward-facing sides of the substantially straight portions are juxtaposed and spaced apart a first distance to define a pipe/tubing passage therebetween. A drive mechanism is provided for transporting the drive chains around the respective loops in synchronized fashion wherein both drive chains move along the pipe/tubing passage in a common direction defining a direction of travel and at a common speed. A plurality of gripper block assemblies are mounted on each drive chain, each gripper block assembly including a gripper block body connected to a respective one of the drive chains and extending from the outward-facing side thereof, at least one pipe insert slidingly mounted to an outward-facing side of the gripper block body for sliding movement between a maximum extension and a minimum extension perpendicular to the direction of travel of the respective drive chain, and at least one spring for each pipe insert. Each spring is operatively connected between the gripper block body and the respective pipe insert and biases the pipe insert outward toward the maximum extension. The first distance between the respective outward-facing sides of the drive chains along the pipe/tubing passage is selectively adjustable, whereby a length of pipe or tubing within the pipe/tubing passage is contacted at nominal portions of the pipe or tubing having a nominal diameter by a first set of the pipe inserts that move a nominal distance from the maximum extension against the bias of the respective springs. The pipe or tubing within the pipe/tubing passage is contacted and at secondary portions of the pipe or tubing having a secondary diameter, which is greater than the nominal diameter, by other sets of the pipe inserts that move a secondary distance, which is greater than the nominal distance, from the maximum extension against the bias of the respective springs of the other sets.

In one embodiment, the drive mechanism further comprises a pair of drive assemblies, each of the drive assemblies being slidably mounted on a common frame assembly and carrying one of the pair of drive chains. A timing mechanism extends between the pair of drive assemblies to synchronize the movement of the drive chains with one another. A plurality of traction cylinders are provided, the traction cylinders being operable to selectively move the drive assemblies relative to one another on the frame assembly to change the first distance across the pipe/tubing passage.

In another embodiment, the timing mechanism further comprises a telescoping torque-tube.

In yet another embodiment, the traction cylinders are connected between the pair of drive assemblies.

In a further embodiment, the joined pipe injector further comprises a skate assembly mounted on each drive assembly, wherein each skate assembly includes a skate body mounted inside the respective loop of drive chain along the substantially straight portion and a plurality of skate rollers rotatably mounted on the skate body in successive rows along the direction of travel to collectively form a substantially flat surface adjacent an inward side of the respective drive chain.

In a still further embodiment, each gripper block assembly further includes a slide plate connected to the gripper block body and disposed on the inward-facing side of the respective drive chain. The slide plate rolls over the skate rollers of the skate assembly along the substantially straight portion of the loop.

In another embodiment, the slide plate includes interleaved portions that simultaneously roll over at least two successive rows of the skate rollers and interfit with the interleaved portions of adjacent slide plates.

In yet another embodiment of the joined pipe injector, each drive assembly further comprises sprockets guiding the drive chain at each end of the pipe/tubing path, whereby motion of the gripper block assemblies attached to the drive chain transitions from curving motion to straight-line motion as the gripper block assemblies travel from the sprockets to the substantially straight portion. The injector further comprises an insert guide positioned between drive assemblies at the end of the pipe/tubing path to apply a pre-compression to the pipe inserts against the bias of the springs of the gripper block assemblies traveling in curving motion prior to those pipe inserts contacting the pipe/tubing and to release the pre-compression when the respective gripper block assemblies are moving in straight-line motion.

In a further embodiment, the insert guide has a double taper configuration including a first tapered portion forming a first angle with a centerline of the pipe/tubing passage, a second tapered portion forming a second angle with the centerline of the pipe/tubing passage, and a dwell portion disposed between the first and second tapered portions.

In a still further embodiment, the gripper block assemblies are removably attached by bolts to the drive chains.

In another embodiment, the springs of the gripper block assemblies attached to the drive chains comprise nitrogen gas springs.

In yet another aspect, a gripper block assembly is provided for a joined pipe injector having a drive chain including a plurality of interconnected links defining a direction of travel of the drive chain. The gripper block assembly comprises a gripper block body having an inward side and an outward side, the outward side being configured to define at least one insert channel having a channel axis and a slide plate having an outward side. The inward side of the gripper block body is mountable on a first side of at least one of a plurality of interconnected links of a drive chain and the outward side of the slide plate is mountable on a second side of the same at least one of the plurality of interconnected links. When so mounted, the gripper block body, the slide plate and the at least one of the plurality of interconnected links move as a unit and the insert channel axis is oriented perpendicular to a direction of travel of the drive chain. The gripper block assembly further comprises at least one pipe insert including an insert body portion and a gripper portion, wherein the insert body portion is slidingly mounted in the insert channel to be moveable between a maximum extension and a minimum extension along the insert channel axis and the gripper portion faces outward from the insert body portion. The gripper block assembly further comprises at least one spring corresponding, respectively, to each pipe insert, each spring having a fixed end portion and a moving end portion, wherein the moving end portion is biased away from the fixed end portion, and wherein the fixed end portion of each spring is operatively connected to the gripper block body and the moving end portion of the spring is operatively connected to the respective pipe insert to bias the respective pipe insert toward the maximum extension along the insert channel axis.

In one embodiment, at least one of the inward side of the gripper block body and the outward side of the slide plate is configured to interfit against the at least one of the plurality of interconnected links to transmit traction force from the drive chain to the gripper block assembly in the direction of travel when the gripper block body is connected to the slide plate across the at least one of the plurality of interconnected links.

In another embodiment, the gripper block body and the slide plate are configured for removable connection of the gripper block body to the slide plate on opposite sides of the at least one of the plurality of interconnected links using bolts.

In yet another embodiment, the inward side of the gripper block body and the outward side of the slide plate are configured to interfit against a single link of the drive chain.

In a further embodiment, the gripper block body defines at least two insert channels, and at least one pipe insert is slidingly mounted in each of the at least two insert channels.

In a still further embodiment, each of the at least one pipe inserts further comprises a multi-radius gripping surface having a plurality of curved portions including a first curved portion and second curved portion. The first curved portion curves with a first radius around a first center, and the second curved portion curves with a second radius around a second center. The second radius has a different length from the first radius, and the locations of the first and second centers are not coincident.

In another embodiment, each of the at least one pipe insert further comprises a pair of lateral arm portions extending away from the gripper portion in lateral directions substantially perpendicular to both the insert channel axis and the direction of travel. The at least one spring corresponding to each pipe insert further comprises at least one spring disposed between the gripper block body and each respective lateral arm portion of each respective pipe insert. Each lateral arm portion is biased independently of the other lateral arm portion by the respective at least one spring disposed under the respective lateral arm portion.

In yet another embodiment, the gripper block body defines two laterally extending insert channels configured parallel to one another. One pipe insert is slidingly mounted in each insert channel; the lateral arm portions each pipe insert extend laterally past each end of the respective insert channel, and one spring is disposed laterally adjacent to each end of each insert channel to bias the respective lateral arm portion toward the maximum extension.

In still another embodiment, the springs of the gripper block assembly comprise nitrogen gas springs.

BRIEF DESCRIPTION OF THE DRAWINGS

For a more complete understanding, reference is now made to the following description taken in conjunction with the accompanying Drawings in which:

FIGS. 1*a*, 1*b* and 1*c* are views of a joined pipe injector in accordance with one embodiment, wherein:

FIG. 1*a* is a front elevation view thereof;

FIG. 1*b* is a side elevation view thereof; and

FIG. 1*c* is a front perspective view thereof;

FIGS. 3*a* and 3*b* are rear perspective views of the injector head assembly of FIG. 2, wherein:

FIG. 3*a* is a full view thereof; and

FIG. 3*b* is an enlarged partial view of the upper portion showing further details of a drive chain timing mechanism in accordance with another aspect;

FIGS. 4*a* and 4*b* show the injector head assembly of FIG. 2 with the front cover plate removed showing the internal machinery spaces, sprockets, drive chains, and insert guides, wherein:

FIG. 4*a* is a front perspective view thereof; and

FIG. 4*b* is a front elevation view;

FIGS. 5*a*-5*d* are partial views of a skate assembly, a drive chain and gripper block assemblies for a joined pipe injector in accordance with an additional aspects, wherein:

FIG. 5*a* is a front perspective view thereof with portions of the drive chain broken away for purposes of illustration;

FIG. 5*b* is a side elevation view thereof;

FIG. 5*c* is a rear perspective view thereof; and

FIG. 5*d* is a rear perspective view similar to FIG. 5*c*, with the skate assembly removed for purposes of illustrating the underside of the drive chain and gripper block assemblies;

FIGS. 6*a*, 6*b* and 6*c* are views of a gripper block assembly and a pipe insert for a joined pipe injector, wherein:

FIG. 6*a* is an exploded front perspective view of a gripper block assembly in accordance with another aspect;

FIG. 6*b* is a front perspective view of a pipe insert in accordance with yet another aspect; and FIG. 6*c* is a front elevation side view of the pipe insert of FIG. 6*b* along with the insert retainers;

FIGS. 8*a*, 8*b* and 8*c* are partial side elevation views of a joined pipe injector handling two sections of jointed pipe having an upset joint, wherein:

FIG. 8*a* is a partial side view of the injector head assembly of the injector showing the two drive assemblies gripping the sections of jointed pipe therebetween; and FIG. 8*b* is an enlarged view of the portion of FIG. 8*a* designated "FIG. 8*b*" showing the portions of the drive chains and gripper block assemblies directly adjacent to the upset joint of the jointed pipe where the two sections are connected; and FIG. 8*c* is a partial side elevation view of the same portion of jointed pipe with the upset joint of FIG. 8*b*, but removed from the injector for purposes of illustration with dashed lines indicating the horizontal alignment of the upset joint portion between FIGS. 8*b* and 8*c*.

DETAILED DESCRIPTION

Figure 1A:
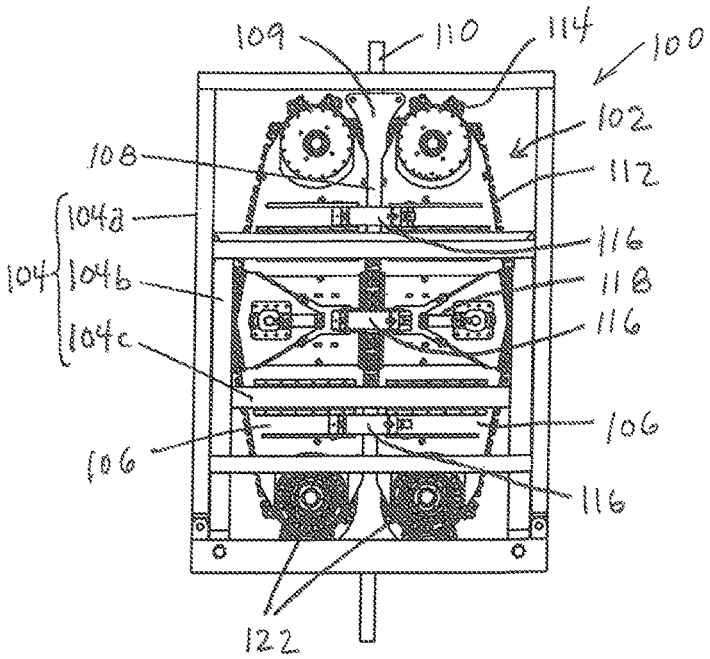

Referring now to the drawings, wherein like reference numbers are used herein to designate like elements throughout, the various views and embodiments of a joined pipe injector are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 1B:
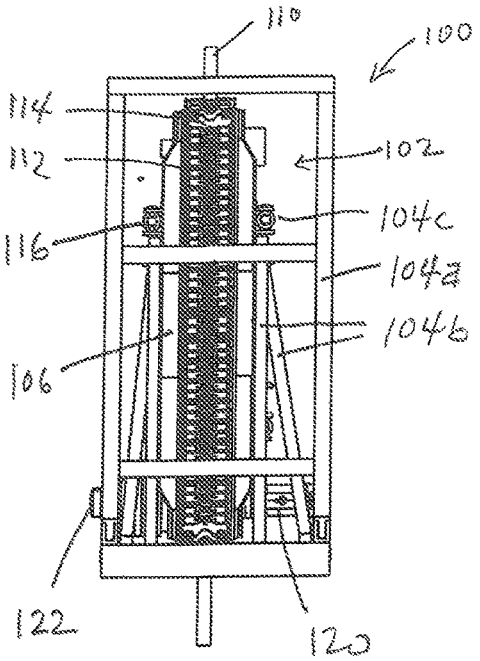
Figure 1C:
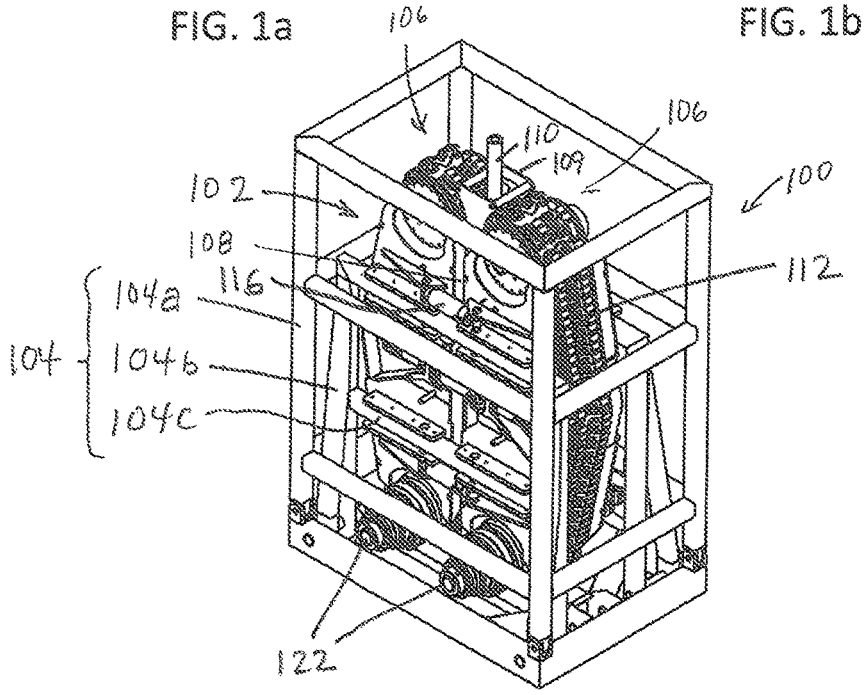

Referring now to FIGS. 1*a*, 1*b* and 1*c*, there are shown, respectively, front, side and front perspective views of a joined pipe injector 100 in accordance with one embodiment. The injector 100 can support, inject and withdraw pipe (including jointed pipe) and tubing (including coiled tubing). For purposes of this application, unless otherwise specified, the term "inject" or "injection" refers to the operation of moving pipe or tubing into the wellbore of a well, and the term "withdraw" or "withdrawal" refers to the operation of moving pipe or tubing from the wellbore of a well. The wellbore may be pressurized or unpressurised during the injection and withdrawal of the pipe or tubing. Other than the drive assemblies and gripper block assemblies further described herein, the remaining portions of the injector 100 may be substantially conventional and therefore not illustrated, including, e.g., the power systems, hydraulic supply systems, tubing/pipe feeding systems etc.

The joined pipe injector 100 can include an injector head assembly 102 mounted on a frame assembly 104. The frame assembly 104 can include an outer frame portion 104*a* and an inner frame portion 104*b*. The outer frame portion 104*a* (or "crash frame") can be configured with height, width and depth dimensions that exceed the respective dimensions of the injector head assembly 102 such that the injector head assembly can be entirely disposed within the confines of the crash frame and thereby substantially protected. The inner frame portion 104*b* (or "sub-frame") can be configured to support the injector head assembly 102. In the illustrated embodiment, the sub-frame 104*b* is pinned to the crash frame 104*a* for ease of assembly and removal; however other forms of connection, such as bolts or welding, can be used in other embodiments. In the illustrated embodiment, the inner frame portion 104*b* includes horizontal support members 104*c* configured to be received within drive support channels 204 (see FIG. 2) on the injector head assembly 102. This configuration allows the drive support channels 204 to slide along the horizontal support members 104*c*, thereby allowing lateral movement of the respective halves of the injector head assembly 102 but resisting upward or downward movement of the injector head assembly caused by the weight of the assembly and/or forces produced during injection and withdrawal of the pipe or tubing.

The injector head assembly 102 includes a pair of drive assemblies 106 spaced apart from one another to define a pipe passage 108 therebetween for accommodating the pipe or tubing 110 to be moved by the injector. During normal use, the pipe passage 108 will be oriented in a direction substantially parallel to the well-bore angle at the surface (i.e., the surface of the ground). As further described below, each drive assembly 106 includes an endless drive chain 112 configured in a loop around two or more supporting sprockets. A plurality of gripper block assemblies 114 are attached to the outward-facing side of the drive chains 112. Portions of the two drive chains 112 are disposed substantially parallel to one another between the drive assemblies 106 such that the gripper block assemblies 114 mounted on the respective drive chains extend towards one another along the pipe passage 108. An insert guide 109 can be mounted between the drive assemblies 106 at one or both ends of the pipe passage 108 to control movement of the gripper assemblies 114 during initial engagement of the pipe or tubing 110 as further described herein.

The injector head assembly 102 can further include one or more traction cylinders 116, one or more tension cylinders 118 and/or one or more drive motors 120. The traction cylinders 116 can be connected between the two drive assemblies 106 and be operated to change the spacing between the drive assemblies (i.e., across the pipe passage 108). The traction cylinders 116 can move the two drive assemblies 106 towards one another to increase the tractive force of the gripper block assemblies 114 against the pipe 110 and can move the two drive assemblies away from one another to decrease the tractive force of the gripper block assemblies against the pipe. In the illustrated embodiment, three traction cylinders 116 are provided on each side of the injector head assembly 102, however, a different number of traction cylinders may be used in other embodiments. In the illustrated embodiment, the traction cylinders 116 are hydraulic cylinder actuators, however, a different type of actuator may be used in other embodiments.

The tension cylinders 118 can be mounted on each drive assembly 106 and operated to change the position of a tension sprocket or roller 402 (see e.g., FIG. 4*a*) disposed within the respective drive assembly so as to change the tension on the respective drive chain 112. In the illustrated embodiment, two tension cylinders 118 are provided on each side of each drive assembly 106, however, a different number of tension cylinders may be used in other embodiments. In the illustrated embodiment, the tension cylinders 118 are hydraulic cylinder actuators, however, a different type of actuator may be used in other embodiments.

The drive motors 120 can be mounted on each drive assembly 106 to rotate a drive sprocket 404 (see, e.g., FIG. 4*a*) disposed within the respective drive assembly that drives the respective drive chain 112. In the illustrated embodiment, one drive motor 120 is provided on each drive assembly 106, however, a different number of drive motors may be used in other embodiments. In the illustrated embodiment, the drive motors 120 are hydraulic motors, however, electric motors, power take offs (PTOs) or other types of drives may be used in other embodiments. In some embodiments the drive motors 120 are synchronous motors, and in other embodiments the drive motors are non-synchronous motors. In the illustrated embodiment, each drive motor 120 drives the respective drive sprocket 404 through a planetary drive or transmission 122 mounted to the drive assembly 106, however, in other embodiments the drive motors may be direct-drive motors or the transmissions may be located elsewhere.

Figure 2:
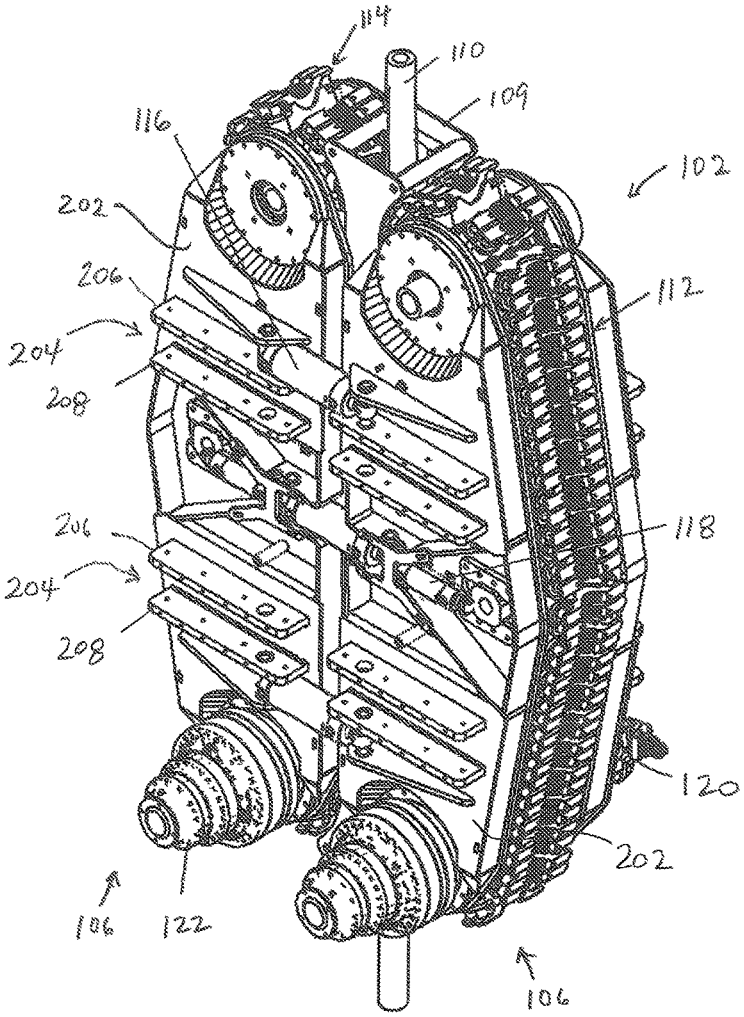
FIG. 2 is a front perspective view of the injector head assembly of the joined pipe injector of FIGS. 1*a*, 1*b* and 1*c;*

Referring now to FIG. 2, the front side of the injector head assembly 102 and tubing 110 are illustrated without the frame assembly 104. Each drive assembly 106 includes a front housing plate 202 connected to an inner frame structure 406 (see, e.g., FIG. 4*a*). The drive support channels 204 (which receive the horizontal support members 104*c* of the frame assembly 104) are mounted to the front housing plates 202. In the illustrated embodiment, the drive support channels 204 comprise spaced-apart upper and lower channel plates 206, 208 mounted to the front housing plates 202.

Figure 3A:
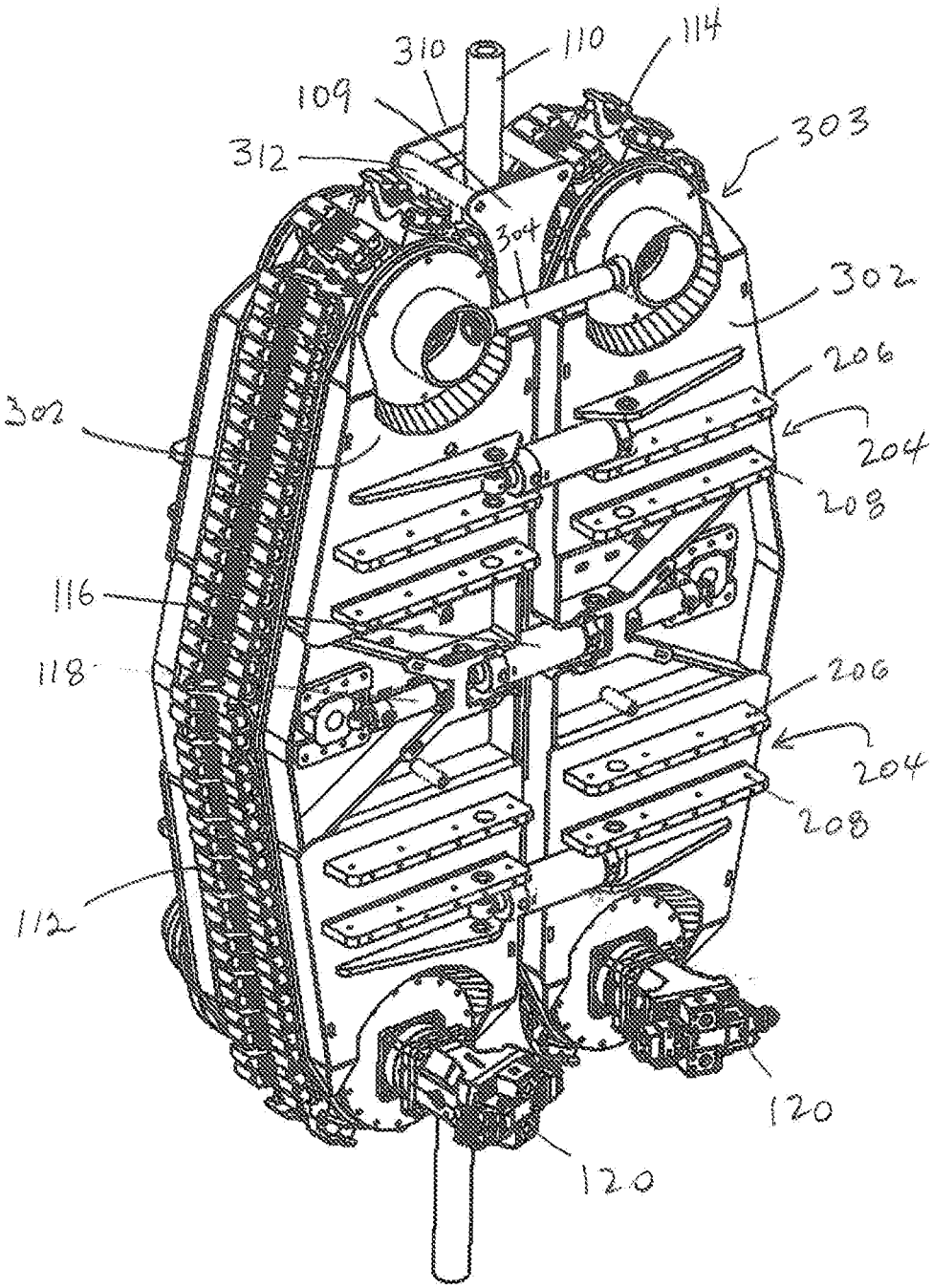
Figure 3B:
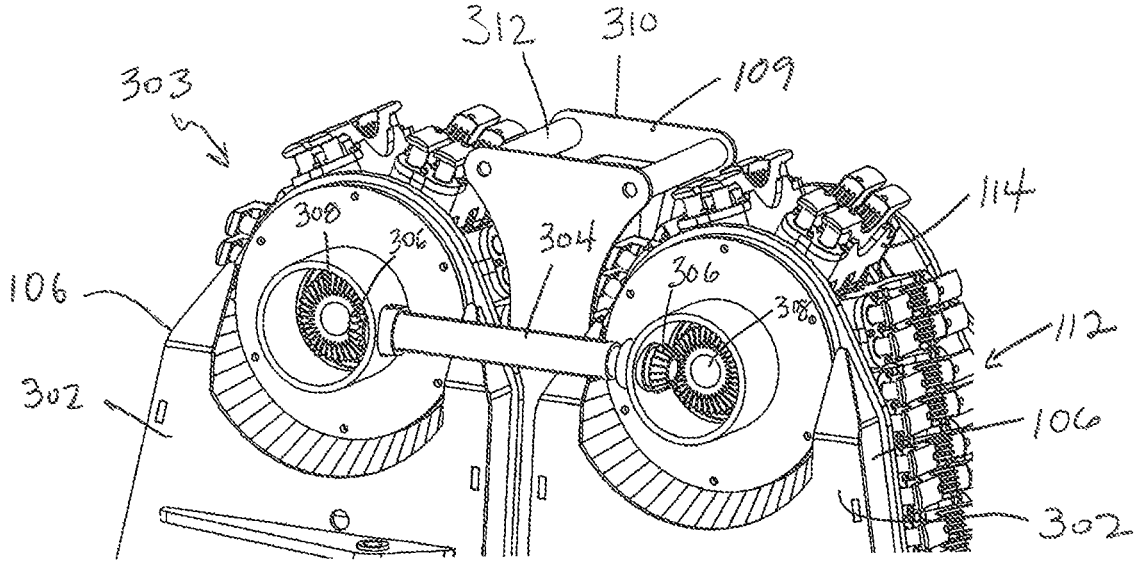

Referring now to FIGS. 3*a* and 3*b*, the rear side of the injector head assembly 102 and tubing 110 are illustrated without the frame assembly 104. Each drive assembly 106 includes a rear housing plate 302 connected to the inner frame structure 406 (see, e.g., FIG. 4*a*). Additional drive support channels 204 are mounted to the rear housing plates 302. In the illustrated embodiment, the rear drive support channels 204 comprise spaced-apart upper and lower channel plates 206, 208 mounted to the rear housing plates 302.

Referring now particularly to FIG. 3*b*, there is illustrated a drive chain timing mechanism 303 for a pipe injector in accordance with another embodiment. The drive chain timing mechanism 303 can comprise a torque tube 304 operatively connected between the two drive assemblies 106 to maintain timing between the respective drive chains 112. In some embodiments, the drive chain timing mechanism 303 can be operatively connected between the respective idler sprockets 408 of each drive assembly 106 to cause the idler sprockets to rotate in synchrony. In other embodiments, the drive chain timing mechanism 303 can be operatively connected between the respective drive sprockets 404 of each drive assembly 106 to cause the drive sprockets to rotate in synchrony. The synchronous rotation of the idler sprockets 408 and/or the drive sprockets 404 caused by the drive chain timing mechanism 303 ensures that the respective drive chains 112 move in synchrony even if non-synchronous drive motors 120 are used to power the respective drive chains. In the illustrated embodiment, the drive chain timing mechanism 303 is mounted to the respective rear housing plates 302 of the two drive assemblies 106 and comprises first bevel gears 306 mounted on the ends of the torque tube 304 that engage second bevel gears 308 connected to the idler sprockets 408; however, other forms of rotational connection may be used in other embodiments. The torque tube 304 can comprise two or more telescoping members that are slidingly engaged to transmit torque while allowing changes in overall length to accommodate relative movement between the two drive assemblies 106.

Figure 4A:
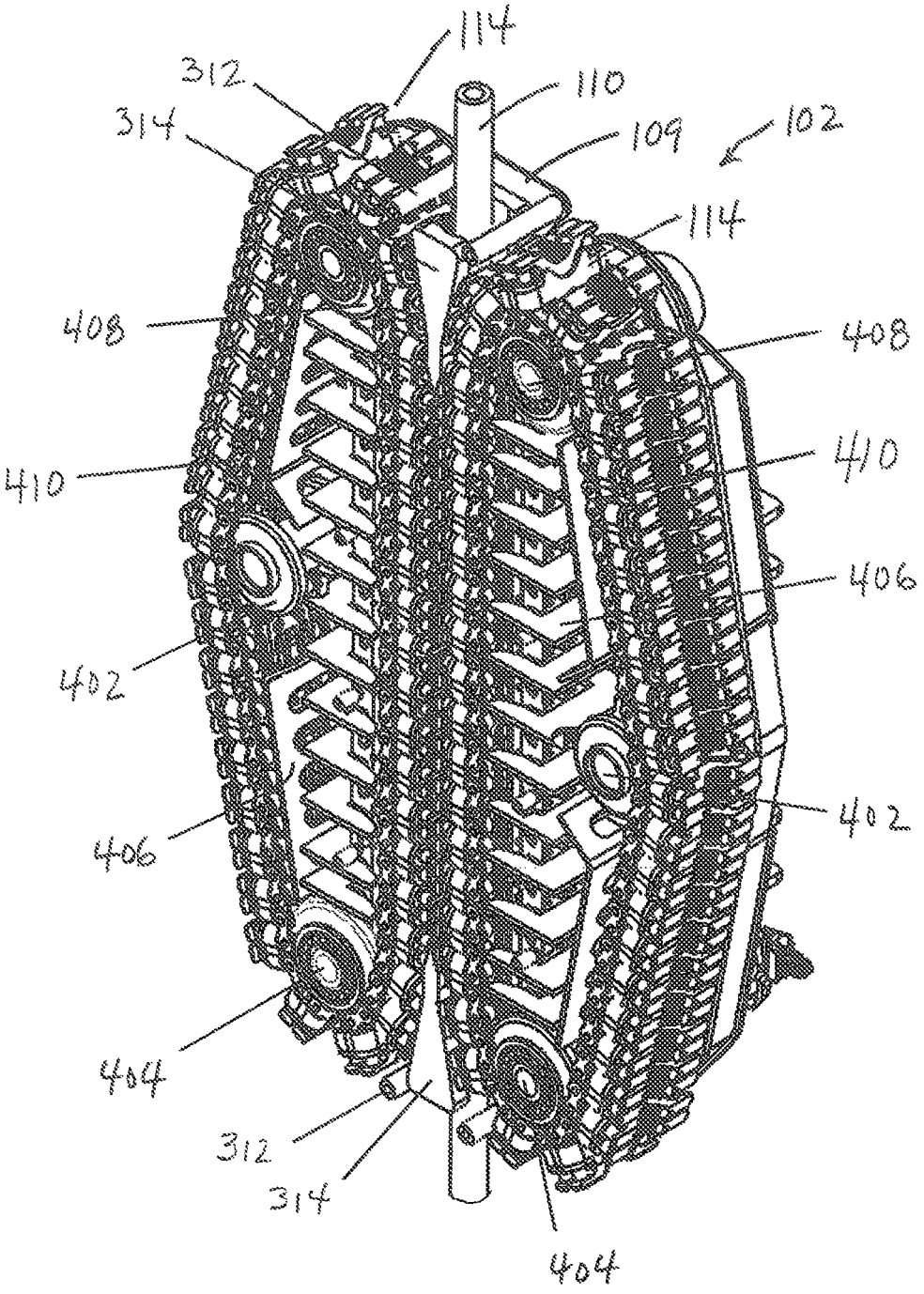
Figure 4B:
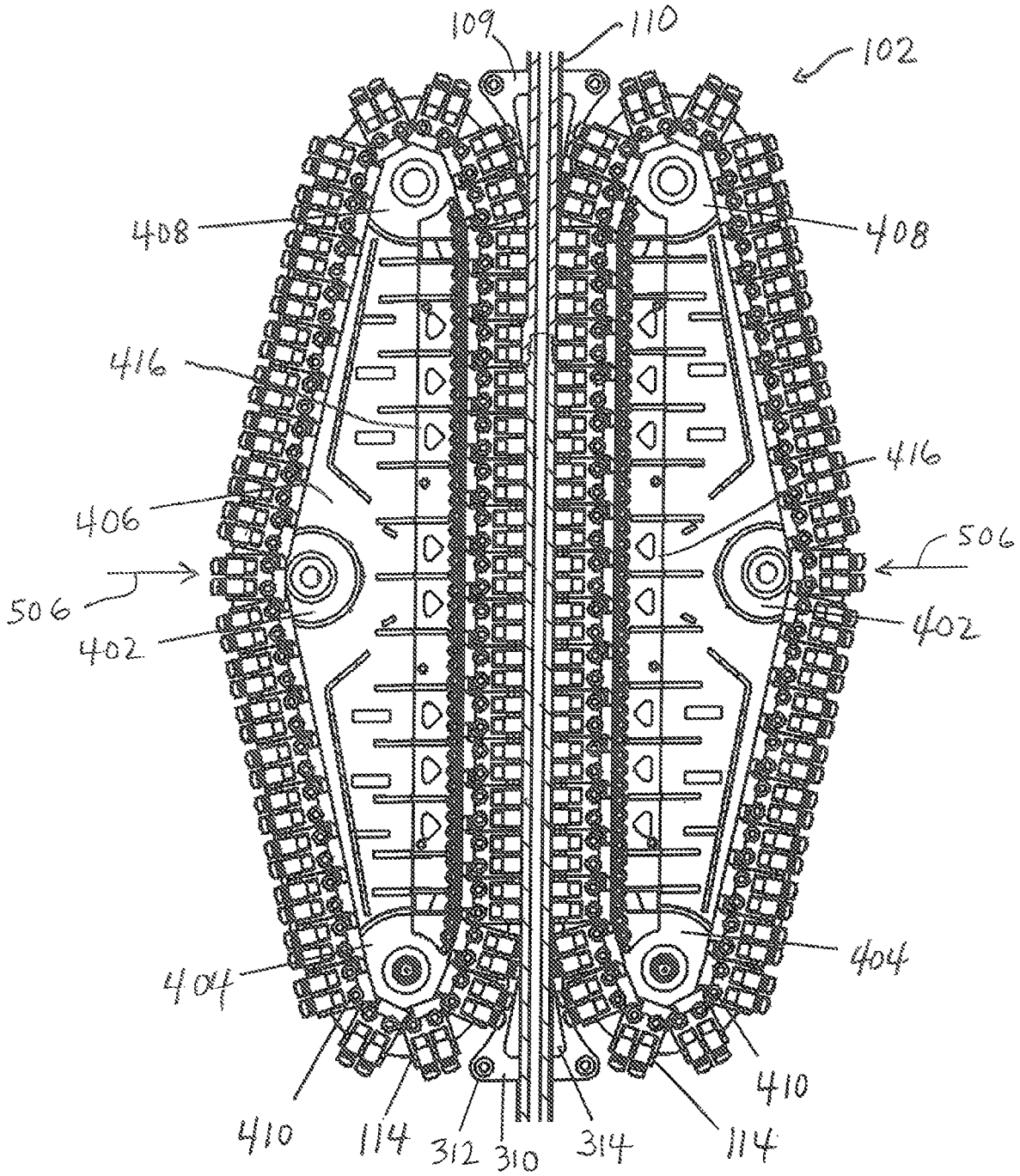

Referring now to FIGS. 4*a* and 4*b*, the injector head assembly 102 is illustrated with the front housing plates 202 removed to show the machinery space within the drive assemblies and the layout of the twin drive chains 112 and the self-adjusting gripper blocks 114 in accordance with additional aspects. Each drive chain 112 comprises an endless roller chain 410 having interconnected links 412 and outer plates 414 routed in a loop around the inner frame structure 406 of the respective drive assembly 106 to engage the respective drive sprocket 404, tension sprocket or roller 402 and idler sprocket 408. Preferably, the endless roller chain 410 is a standard roller chain, and in the illustrated embodiment, the roller chain is a standard quad roller chain.

In the illustrated embodiment, the idler sprockets 408 are disposed uppermost within the respective drive assemblies 106, the drive sprockets 404 are disposed lowermost and the tension sprockets or rollers 402 are disposed therebetween. In other embodiments, the positions of the various sprocket and rollers may be rearranged; however, the respective functions will be substantially the same. For purposes of description, the section of drive chain 112 running between the uppermost sprocket and lowermost sprocket along the pipe passage 108 (i.e., near the mid-line of the injector head assembly 102) can be referred to as the "driving section" of the drive chain loop, and the remaining sections of drive chain running around the outer periphery away from the inner pipe passage can be referred to as the "return section" of the drive chain loop. During typical operation of the injector 100, the driving section of the drive chain 112 has a direction of travel that is generally aligned with the well-bore angle at the surface (i.e., generally downward or slanting downward for injection and generally upward or slanting upward for withdrawal).

Referring now also to FIGS. 5*a*-5*d*, the gripper block assemblies 114 can be firmly attached to the drive chain 112 such that the gripper block assemblies are carried around the drive assembly 106 by the drive chain. Each gripper block assembly 114 can include a gripper block body 502 (or gripper block upper portion) and a slide plate 504 (or gripper block lower portion). Preferably, the gripper block body 502 can be removably attachable to the slide plate 504 to facilitate assembly and removal of the gripper block assemblies 114 from the drive chain 112. In the illustrated embodiment, the underside of the gripper block body 502 and the upper side of the slide plate 504 are configured to "capture" a link 412 of the drive chain 112 therebetween for removably mounting the gripper block assembly 114 to the drive chain. Preferably the various components of the gripper block assemblies 114 do not act as tensile load-bearing components of the drive chain 112; for example, the tensile load-carrying capacity of the drive chain can be the same with our without the gripper block bodies 502 or slide blocks 504 being mounted thereon.

Figure 5A:
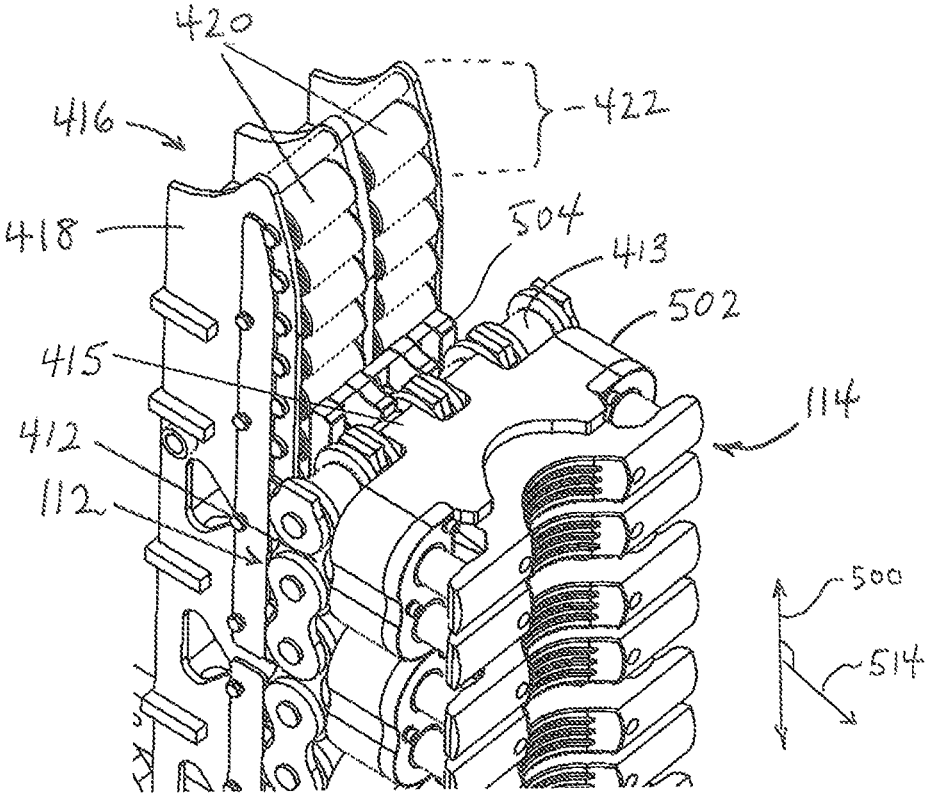
Figure 5B:
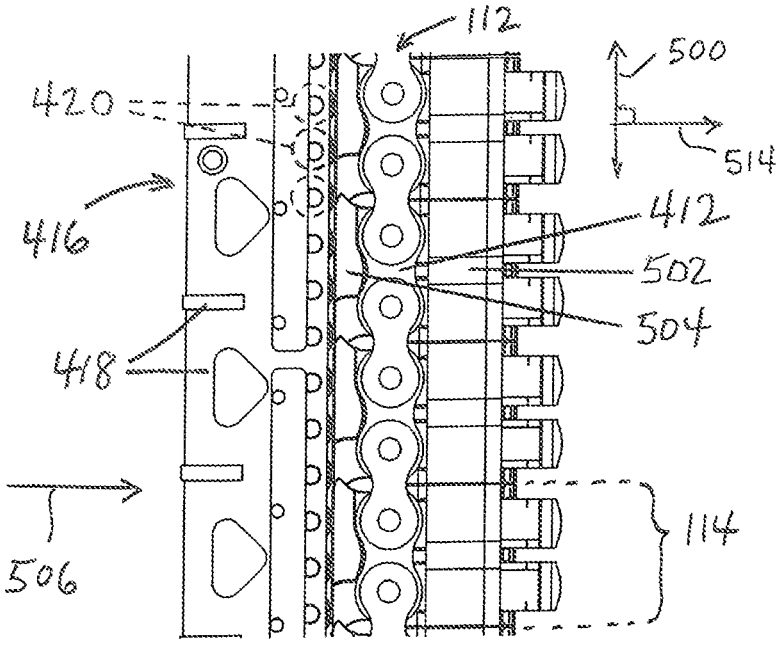
Figure 5C:
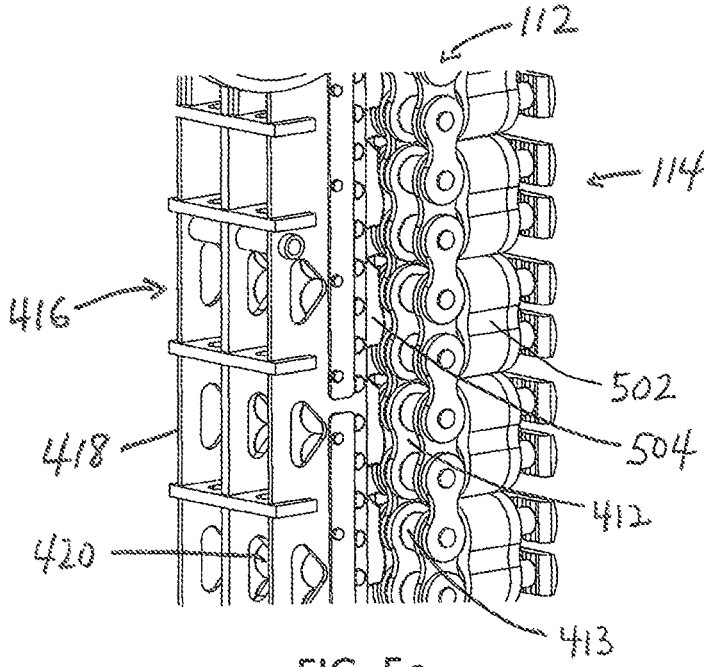

Referring now particularly to FIG. 5*a*, the gripper block body 502 and/or slide plate 504 can be configured to connect to the links 412 of the drive chain 12, and especially to the link rollers 413, so as to transmit lateral force (i.e., traction force) in the direction of movement 500 from the drive chain to the pipe or tubing 110 (i.e., via the gripper block assemblies 114). In the illustrated embodiment, the gripper block bodies 502 includes one or more semi-circular force-transmitting surfaces 415 that cooperate with the rollers 413 of the link 412 to transmit traction force.

Referring still to FIG. 5*a*, each drive assembly 106 can further comprise a skate assembly 416 having an elongated skate body 418 and a plurality of skate rollers 420. For purposes of illustration, FIG. 5*a* shows the skate assembly 416 and a portion of the drive chain 112 (including gripper block assemblies 114) removed from the drive assembly 106. Each skate body 418 can be mounted to the internal structure 406 of the respective drive assembly 106 laterally adjacent to the driving section of the drive chain 112 with the elongated dimension of the skate body generally aligned with the direction of travel (denoted 500 in FIG. 5*a*) of the driving section. In some embodiments, the skate assemblies 416 are bolted to the internal structure 406 of the respective drive assemblies 106 to provide a rigid connection but allow ease of assembly and maintenance; however, other types of connection, such as welding, may be used in other embodiments. The skate rollers 420 can be rotatably mounted to the skate body 418 with the axes of rotation of each roller being oriented generally parallel to the (inner/rear) surface of adjacent drive chain 112 and generally perpendicular to the direction of travel 500 of the adjacent driving section, thereby collectively forming a rolling support surface. In the illustrated embodiment, the rolling support surface formed collectively by the rollers 420 is substantially planar, except at the ends where the skate body 418 includes a taper 422 to accommodate the curve of the drive chain 112 as it enters/exits the drive and idler sprockets 404, 408.

As best seen in FIG. 4*b*, as the two drive assemblies 106 move horizontally towards one another across the pipe passage 108 during operation of the injector 100, the skate assemblies 416, which are connected to the respective drive assemblies, likewise move towards one another (denoted in FIG. 5*b* by arrow 506), thereby applying force against the undersides of the gripper assemblies 114, and in this embodiment applying force from the rollers 420 against the undersides of the slide plates 504, as the gripper assemblies are transported along the driving sections of the respective drive chains 112. As further described herein, the inward force (in direction 506) provided by the skate assemblies 416 against the back of the gripper assemblies 114 can transmit tractive force from the drive chains 112 to the tubing 110 in the pipe passage 108.

Figure 5D:
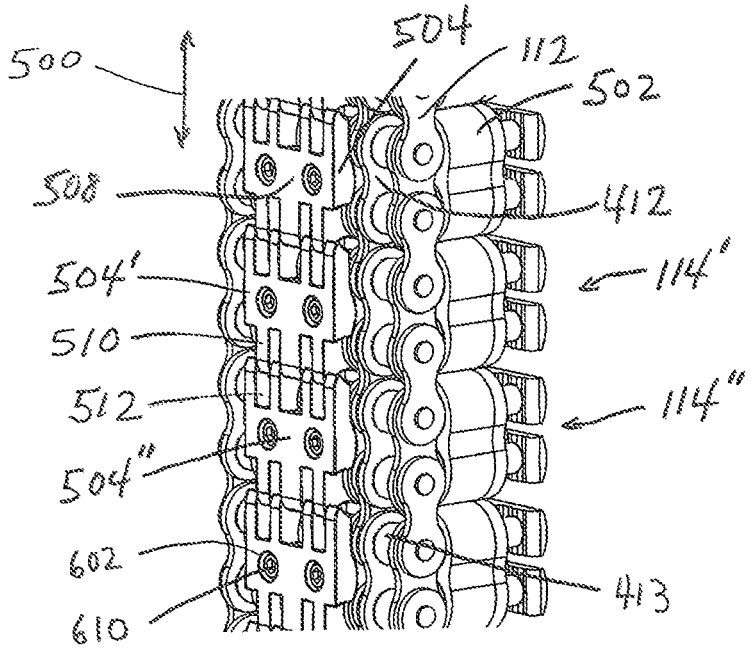

Referring now particularly to FIGS. 5*d*, a rear view of the drive chain 112 and gripper block assemblies 114 is provided with the skate assembly 416 removed for purposes of illustration, thereby showing the underside surfaces 508 of the slide plates 504 of several successive gripper block assemblies, e.g., assemblies 114' and 114". The slide plates 508 can be configured to collectively form a substantially flat surface that rolls on the upper side surface of the skate rollers 420 of the skate bar assembly 416 during operation of the injector 100. In the illustrated embodiment, the underside surface 508 of each slide plate 504 can be configured to define one or more fingers 510 and one or more slots 512 extending each way along the direction of travel 500. The fingers 510 and the slots 512 on the slide block 504 can be dimensioned and configured such that the fingers 510 of one slide block 504' are disposed at least partially within the slots 512 of an identical side block 504" on a successive gripper block assembly 114" in an interleaved arrangement. Because of this interleaving, each skate roller 420 can simultaneously contact fingers 510 from two adjacent slide plates 504 as the interleaved fingers pass over the roller. In this manner, the forces exerted by the rollers 420 may be smoothly transferred between successive slide plates 504' and 504", and hence between successive gripper assemblies 114' and 114".

Figure 6A:
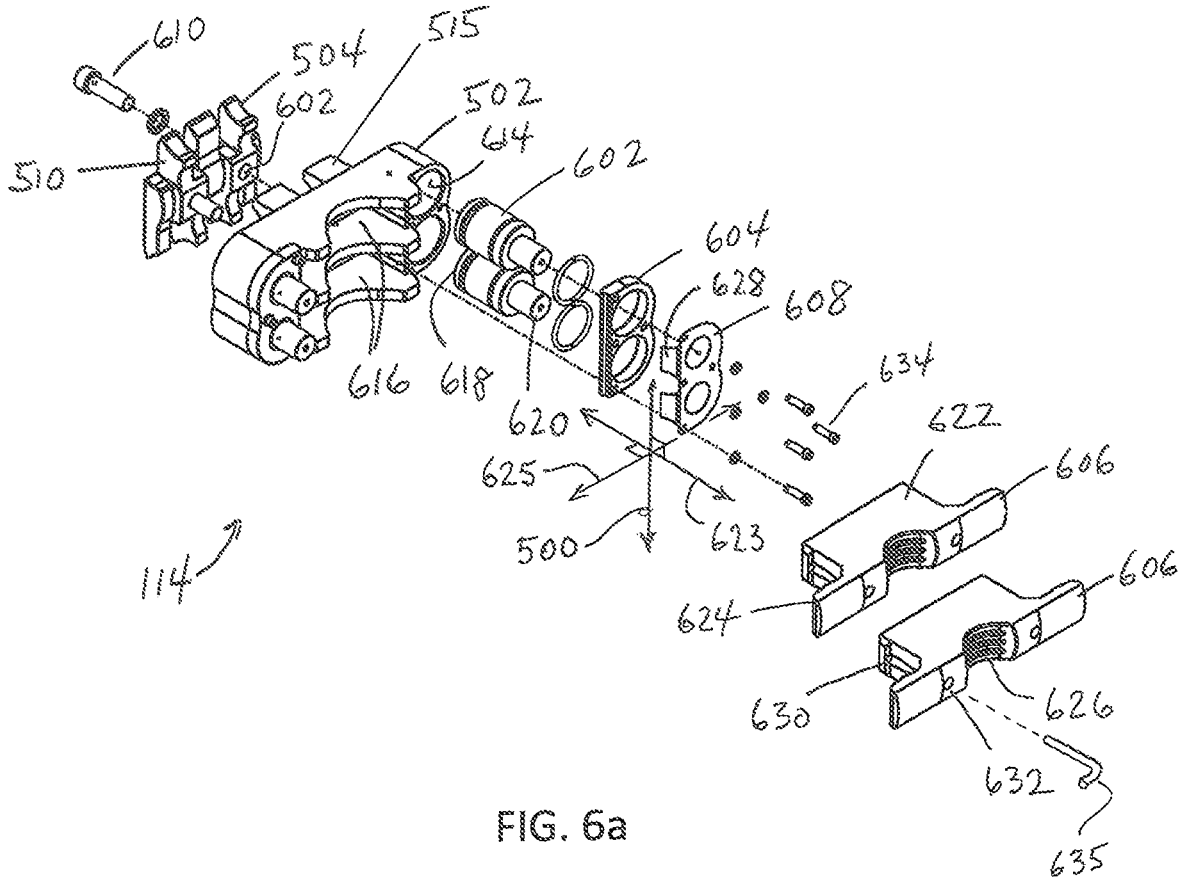

Referring now to FIG. 6*a*, each gripper block assembly 114 can include, in addition to the gripper block body 502 and slide plate 504, one or more springs 602, spring retainers 604, pipe inserts 606 and insert retainers 608. In the illustrated embodiment, each gripper block assembly 114 includes two pipe inserts 606 and two springs 602 per insert for a total of four springs; however, in other embodiments, the gripper block assembly can include a different number of pipe inserts, springs and/or springs per insert. For purposes of illustration, in FIG. 6*a* the gripper block assembly 114 is shown in exploded view and the interconnecting links of the drive chain 112 are not shown. As previously described, each gripper block assembly 114 can be removably attached to a link 412 of the drive chain 112 by capturing the link between the gripper block body 502 and the slide plate 504. In the illustrated embodiment, bolts 610 can pass through holes 612 in the slide plate 504, between the rollers of the chain link 412, and threadingly engage the underside of the gripper block housing 502, thereby releasably capturing the chain link between the gripper block housing and the slide block. It will be appreciated that, in this configuration, neither the gripper block housing 502 nor slide plate 504 is an integral part of the chain 112; i.e., the tensile load-carrying capacity of the chain is the same with our without the gripper block housing or slide block attached thereto.

Figure 6B:
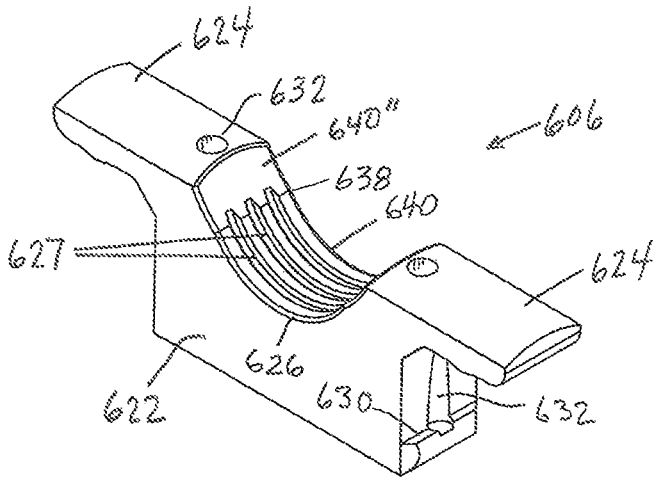
Figure 6C:
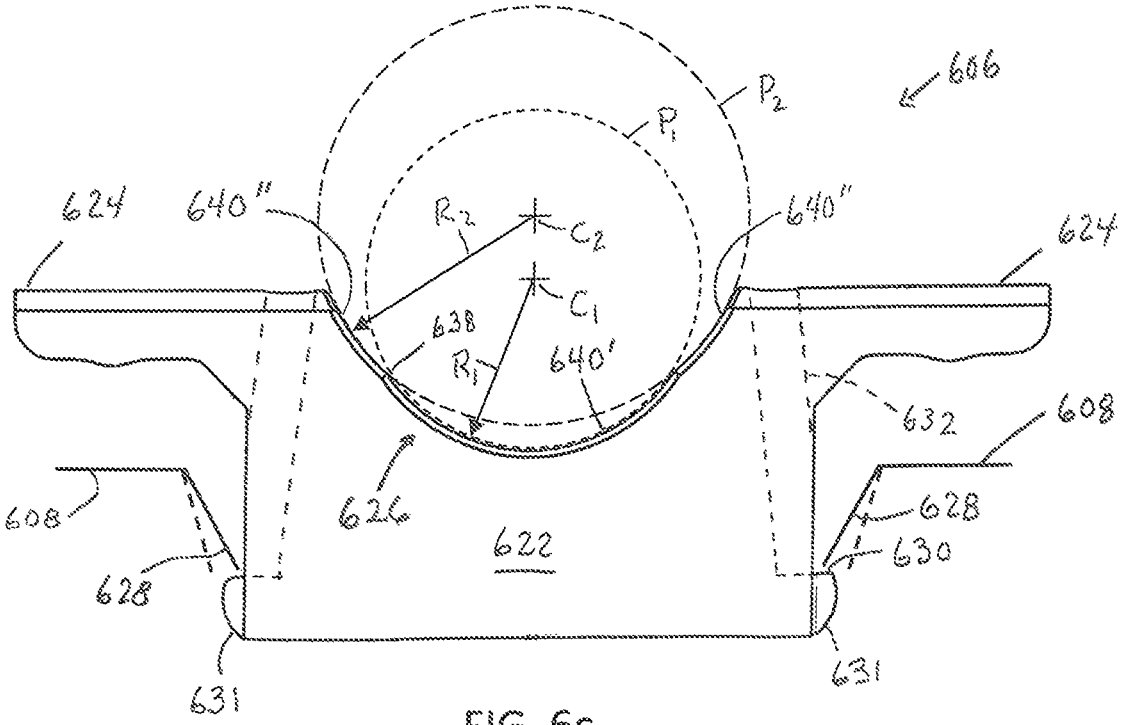

Referring now also to FIGS. 6*b* and 6*c*, the pipe inserts 606 act as floating jaws. The pipe inserts 606 are the elements of the gripper block assembly 114 that actually contact the pipe or tubing 110 and transfer the traction force of the drive chain 112 to the tubing. The gripper block bodies 502 are mounted to the drive chain 112 but do not typically contact the tubing 110. Each pipe insert 606 can be mounted in a cavity or channel 616 of its respective gripper block body 502 so that the insert is rigidly supported by the gripper block body in the machine direction (i.e., in the direction of travel 500 of the drive chain 112 around the sprockets) but is flexibly supported in the outward direction 514 (FIG. 5*b*) perpendicular to the machine direction. This allows the pipe inserts 606 to move in-and-out within the socket 616 as the pipe or tubing is contacted and released. The spring elements 602 (e.g., gas springs described below) bias the pipe inserts 606 to push outward from the socket 616 of the gripper block bodies 502 to provide gripping force when the insert contacts the tubing 110. The pipe insert 606 is preferably independently supported by the spring elements 602 on each side of the drive chain centerline so that the insert can "float" as necessary to accommodate off-center forces.

As best seen in FIG. 6*a*, the upper side of the gripper block body 502 can be configured to define one or more outward-facing spring cavities 614 and one or more outward-facing insert cavities or channels 616. In this context, the outward direction 514 (also shown as direction 623 in FIG. 6*a*) is perpendicular from the localized direction of travel 500 of the drive chain 112 when the gripper block assembly 114 is mounted to the drive chain. The springs 602 can be mounted in the spring cavities 614 and secured in place with the spring retainers 604 such that a fixed portion 618 of the spring bears against the gripper block body 502 and outwardly biases a movable portion 620 of the spring. The pipe insert 606 can have a sliding portion of the body 622 that is configured to slide or "telescope" within the outward-facing insert channel 616 along a channel axis 623 (running essentially parallel to the outward direction 514). In the illustrated embodiment of FIG. 6*a*, the insert channels 616 have a rectangular configuration, and the sliding portions of the insert bodies 622 have a compatible rectangular configuration; however, in other embodiments, the insert channels and insert bodies can have other compatible configurations, i.e., which allow the insert body to move within the insert channel along the channel axis 623 while substantially maintaining the orientation of the gripper portion 626 relative to the direction of travel 500.

The pipe insert 606 can be operatively connected to the movable portion 620 of the spring 602 such that the pipe insert is upwardly biased by the spring away from the gripper block body 502, however, upward movement of the pipe insert can be limited by the pipe insert retainer 608 such that at least a portion of the sliding portion the pipe insert is retained in the insert channel 616. The pipe insert 606 can further be configured to have a gripper portion 626 dimensioned to accommodate the pipe or tubing to be handled by the injector 100. In the illustrated embodiment, the gripper portion 626 includes a U-shaped curve having circumferential teeth or grooves 627 for gripping the pipe. To allow the injector 100 to handle different types of pipe or tubing, the pipe inserts 606 can be removed and replaced with alternative pipe inserts having a similar configuration (to fit in the same pipe insert cavities 616) except for a different configuration of the gripper portion 626. Similarly, to allow the injector 100 to provide a different capacity of gripping force, the springs 602 can be removed and replaced with alternative springs having a similar configuration (to fit in the same spring cavities 614) except having different spring characteristics, e.g., spring rate, preload, usable stroke, etc.

As best seen in FIGS. 6*b* and 6*c*, the pipe inserts 606 can have a center body portion 622 with a U-shaped, curved gripper portion 626 disposed on the outward-facing surface between a pair of lateral arms 624. The gripper portion 626 can have circumferential slots or teeth 627 formed on the outer surface for better gripping the pipe. When the pipe insert 606 is mounted to the gripper block body 502, the center portion 622 is typically disposed at least partially within the gripper block cavity or channel 616 with the curved gripper portion 626 remaining exposed. Each lateral arm 624 of the insert 606 is supported by a spring element 602 mounted in the gripper block body 502 behind (i.e., underneath) the lateral arm. The dimensions of the U-shaped central curve 626 of the gripper portion can be selected to engage the desired pipe size.

In some embodiments, the pipe insert 606 can have a gripper portion 626 configured with a U-shaped curved gripping surface having a single center point and single radius of curvature. In other embodiments, the pipe insert 606 can have a gripper portion 626 with a multi-radius gripping surface 638 configured to better grip pipe of different diameters or pipe having different diameters along the pipe-string. For example, a string of jointed pipe (FIG. 8*c*) has portions with two different diameters, a first nominal outer diameter (O.D.) along the majority of the pipe and a second, larger, O.D. at the collars/upsets/joints where the pipe sections join. The multi-radius gripping surface 638 has a plurality of curved portions 640, wherein at least some of the curved portions have different center points and different radii of curvature.

In the embodiment illustrated in FIGS. 6*b* and 6*c*, the gripper portion 626 of the pipe insert 606 has a multi-radius gripping surface 638 with a plurality of curved portions 640, namely first curved portion 640' and second curved portions 640". The first curved portion 640' curves with a first radius (denoted $R_1$) about a first center (denoted $C_1$) located at a first position, thus being well configured for gripping pipe $P_1$ (shown in broken line) having a first O.D.=($2\times R_1$). The second curved portions 640" curves with a second radius (denoted $R_2$) about a second center (denoted $C_2$) located at a second position, thus being well configured for gripping pipe $P_2$ (shown in broken line) having a second O.D.=($2\times R_2$). For a string of jointed pipe, pipe $P_1$ can be the O.D. of the nominal sections and pipe $P_2$ can be the O.D. of the collars/upsets/joints. The gripping teeth or grooves 627 can be formed in some or all of the curved portions 640', 640" of a multi-radius gripping surface 638. In the illustrated embodiment, the first curved portion 640' of the smaller radius $R_1$ is disposed in the center of the multi-radius gripping surface 638, with the second curved portions 640" of the larger radius $R_2$ disposed on each side thereof, however in other embodiments, different numbers of the curved portions 640 of different radii can be provided and/or the curved portions of different radii can be arranged differently.

Referring again to FIG. 6*a*, the springs 602 can be nitrogen gas springs. Nitrogen gas springs are preferred for the springs 602 in some embodiments where relatively high spring preload and relatively short overall spring length are required while still providing sufficient useable stroke after preload. In some embodiments, the springs 602 are nitrogen gas springs having a preload gas pressure of approximately 2700 psi. In some embodiments the springs 602 have a usable stroke of at least 1.25 inches from an overall length of not more than 4.0 inches, regardless of pre-load. In other embodiments, the springs 602 can be other types of gas springs or mechanical springs including, but not limited to, coil springs, belleville springs, leaf springs, elastomeric springs or pneumatic springs.

Referring still to FIGS. 6*a*, 6*b* and 6*c*, the pipe inserts 606 can have lateral arm portions 624 extending in a lateral direction 625 (i.e., perpendicular to both the channel axis 623 and the direction of travel 500) from the sliding portion 622 on each side of the gripper portion 626 and contacting the moving portions 620 of the springs 602. The lateral arm portions 624 can be combined with lateral oversizing of the pipe insert channel 616 to provide the pipe insert 606 with a limited range of lateral movement (i.e., in direction 625 of FIG. 6*a*) during operation. In other embodiments, the springs 602 may be disposed partially or completely behind the pipe inserts 606, e.g., within the sliding portion 622.

For ease of assembly, repair and replacement, the pipe inserts 606 can be secured on the gripper block bodies 502 using insert retainers 608. One or more insert retainer 608 can be used on the gripper block body 502 for each pipe insert 606, for example two retainers can be used to hold in each pipe insert. The insert retainers 608 preferably merely hold the pipe inserts 606 in place on the gripper block bodies 502; the only force the insert retainers have to withstand is the weight of the pipe insert itself. The insert retainers 608 can be secured to the gripper block body using bolts 634 or other fasteners. In the illustrated embodiment, the same bolts 634 secure both the insert retainers 608 and the spring retainers 604. The pipe inserts 606 and insert retainers 608 can have a quick-disconnect feature that allows the inserts to be removed from the gripper block bodies 502 by inserting a key 635 or tool into a keyway 632 to selectively move or change the shape of the retainer and release the insert from the gripper block.

As best seen in FIGS. 6*a* and 6*c*, in the illustrated embodiment, the pipe insert retainers 608 include quick-disconnect features comprising spring clips 628 that angle downward and laterally inward from the interior lateral sides of the retainer into the insert cavities 616. As the pipe insert 606 is inserted into the insert cavity 616 along axis 623, the curved lower corners 631 of the sliding portion 622 push the spring clips 628 laterally outward (as shown in phantom in FIG. 6*c*), thus biasing the clips inward (i.e., back toward the center of the cavity). As the retaining shoulders 630 of the pipe insert 606 pass the ends of the spring clips 628, the ends of the clips (urged by the bias) move back laterally inward above the retaining shoulders. Subsequent withdrawal of the pipe inserts 606 from the cavity 616 is prevented by interference between the shoulders 630 and the ends of the spring clips 628. When thus secured by the spring clip 628, the pipe insert 606 can still move up and down within the socket 616 (e.g., between maximum extension and minimum extension), but the insert cannot be removed from the gripper block body 502 without repositioning the spring clips. Each pipe insert 606 secured by the spring clip 628 of retainer 608 can be removed for maintenance or replacement by inserting a key 635 (FIG. 6*a*) into a keyway 632 formed through the upper surface of the pipe insert. The inserted key 635 pushes the respective spring clip 628 laterally out of the way of the retaining shoulder 630 (i.e., back to the position shown in phantom in FIG. 6*c*), such that the pipe insert 606 can be withdrawn from the gripper block body 502 while the keys remain in the keyways. The pipe insert 606, or a replacement pipe insert, can be inserted into the cavity 616 and locked in place by the spring clips 628 without requiring the key.

Figure 7:
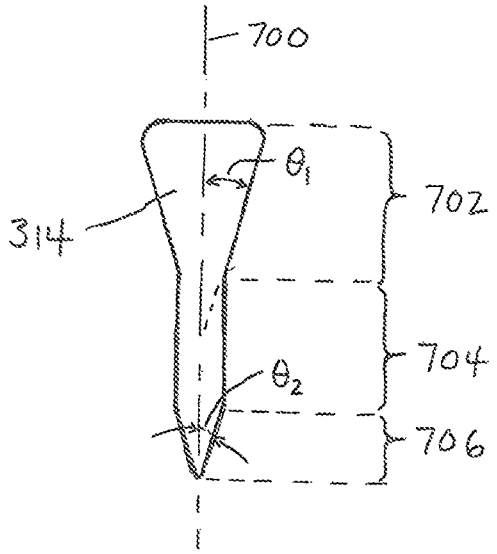
FIG. 7 is a side elevation view of a guide block for an insert guide for a joined pipe injector in accordance with another aspect.

Referring once again to FIGS. 3*a*-3*b*, 4*a*-4*b*, and also to FIG. 7, the insert guides 109 are structures located near the top and bottom ends of the pipe gap 108 between the drive assembly halves 106. The insert guides 109 pre-compress the spring elements 602 to guide the pipe inserts 606 along a predetermined path during transition from circular motion to straight-line motion at the top and bottom of the pipe gap 108 prior to contacting the pipe or tubing 110. Without the insert guides 109, the pipe inserts 606 tend to slide on/against the pipe 110 during transition from circular motion to straight-line motion until purely straight-line motion is achieved. Damage to components of the injector 100 and/or to the pipe 110 can occur if a sliding pipe insert 606 contacts an upset joint 802 (FIG. 8*c*) of the pipe. The insert guide 109 pushes the pipe inserts 606 inward into the gripper block bodies 502 during curved motion, thereby delaying contact between the pipe insert and the pipe or upset joint until the insert is traveling with straight-line motion. As pipe insert 606 achieves straight-line motion, the insert guide 109 can gradually release the pipe insert to contact the pipe 110. The insert guide 109 can be mounted to brackets and bolted to a center frame of the injector 100. The insert guide 109 can be configured with a double taper profile (FIG. 7) to first gradually compress the pipe insert 606 and then gradually contact the pipe 110 when correctly aligned.

Referring still to FIGS. 3*a*-3*b*, 4*a*-4*b*, and also to FIG. 7, in the illustrated embodiment the pipe insert 109 can be located at the top and bottom of the injector 100 at the ends of the driving section of the drive chain 112. The insert guides 109 are configured to contact the pipe inserts 606 as the gripper block assemblies 114 move along a curving path to enter the pipe passage 108. The insert guides 109 can move the pipe inserts 606 inward into the gripper block body 502 against the bias of the springs 602 to prevent the pipe inserts from contacting the pipe or tubing 110 where the drive chain is moving on a curving path (i.e., where the pipe inserts are not substantially parallel with the surface of the pipe or tubing). The insert guides 109 are further configured to release contact with the pipe inserts 606 as the gripper block assemblies 114 move fully into the driving section of the drive chain 112 and have substantially straight-line motion (i.e., where the inserts are perpendicular to the pipe surface).

Each insert guide 109 can include a pair of side plates 310 connected by a pair of spacer tubes 312 forming a pipe or tubing inlet/exit at the ends of the pipe passage 108. A guide block 314 is mounted on the inner side of each side plate 310 such that the guide blocks contact each successive pipe insert 606 as the drive chain 114 moves around the sprocket 404 or 408 to enter the driving section. The guide blocks 314 are best seen in FIG. 4*a*, wherein the front side plates 310 are removed for purposes of illustration, but the guide blocks are depicted in their operational positions. In the illustrated embodiment, the guide blocks 314 are configured to contact the lateral arm portions 624 of the pipe inserts 606 while remaining clear from the pipe or tubing 110 being handled by the injector 100. As best seen in FIG. 7, the working surfaces of the guide blocks 314 of the insert guides 109 can be configured with a double linear taper configuration (i.e., on each side of the guide block) having an initial linear taper section 702 forming a first taper angle $\theta_1$ from the pipe centerline 700, a dwell section 704 substantially parallel to the pipe centerline, and a final linear taper section 706 forming a second taper angle $\theta_2$ with the pipe centerline. In other embodiments, the working surfaces of the guide blocks 314 can have different configurations including a single linear taper configuration, a double curved taper configuration or a single curved taper configuration.

Figure 8A:
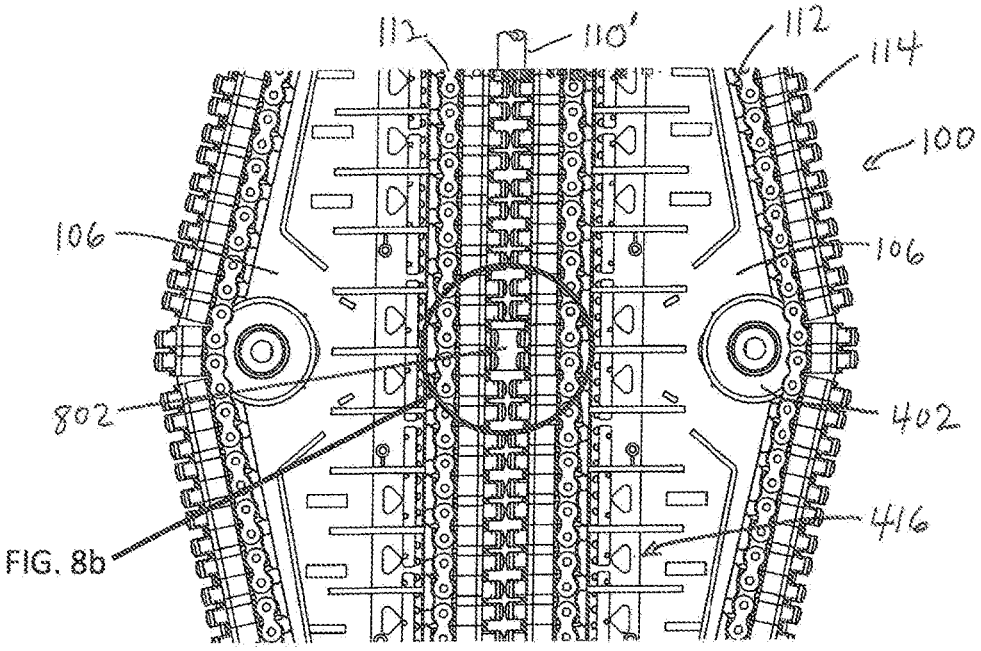
Figure 8B:
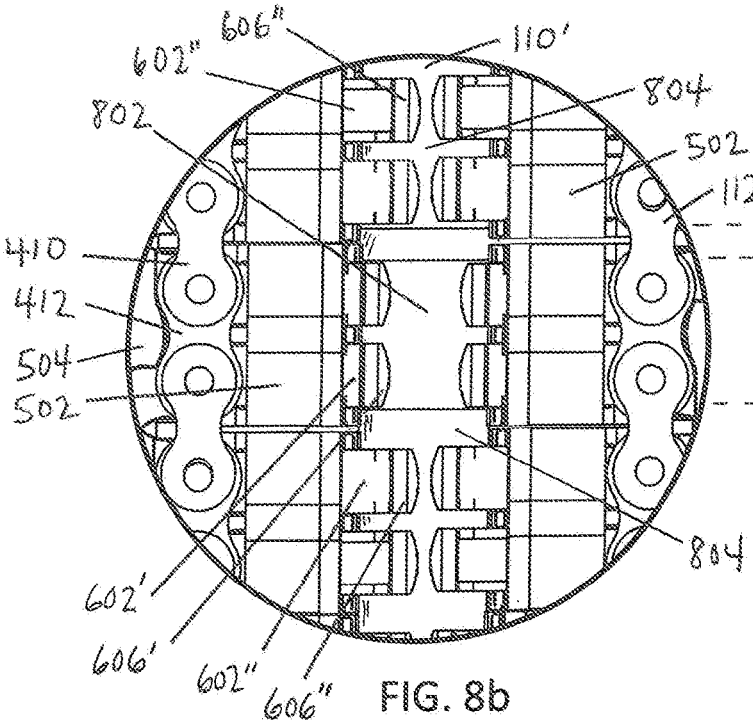

Referring now to FIGS. 8*a* and 8*b*, when the injector 100 is in use, the drive assemblies 106 are oriented with the straight portions of the drive chain loops substantially aligned with the well-bore at the surface (i.e., parallel to the well-bore angle at the surface) and parallel to one another on either side of the pipe/tubing passage 108. The drive assemblies 106 may be slidably mounted to a frame assembly 104 to allow the drive assemblies to move perpendicular to the well-bore angle while maintaining the substantially parallel orientation of the pipe/tubing passage. As previously described herein, as the drive assemblies 106 are pressed towards one another (i.e., towards the pipe/tubing passage 108), the skate bar assemblies 416 press against the underside surface 508 of the slide plates 504 carried by the drive chains 112, thereby pressing the gripper blocks assemblies 114 with the outwardly-facing pipe inserts 606 against the pipe or tubing 110 positioned therebetween. The traction cylinders 116 can be operatively connected to the drive assemblies 106 to selectively move the assemblies together and apart and/or to exert greater or less force between the assemblies. In the illustrated embodiment, the traction cylinders 116 are connected between the drive assemblies 106, and as the inward pull of the traction cylinders increases, the drive assemblies are pulled more strongly towards one another to increase the tractive force exerted by the pipe inserts 606 against the pipe, and as the inward pull of the traction cylinders is reduced, the drive assemblies are pulled less strongly towards one another to reduce the tractive force. The traction cylinders 116 may also push against the drive assemblies 106 to move the assemblies apart to change the spacing across the pipe/tubing passage 108. Depending upon the value of the preload force of the springs 620 in the gripper block assemblies 114 compared to the selected tractive force desired from the gripper block assemblies against the pipe or tubing 110, in some cases the pipe inserts 606 can be undeflected (i.e., at the maximum extension) while gripping the pipe or tubing, and in other cases the pipe inserts can be deflected (i.e., between the maximum extension and the minimum extension) while gripping the pipe or tubing. As further explained below, in yet other cases, the various pipe inserts 606 at different positions along the pipe or tubing 110 may have different values of deflection.

Figure 8C:
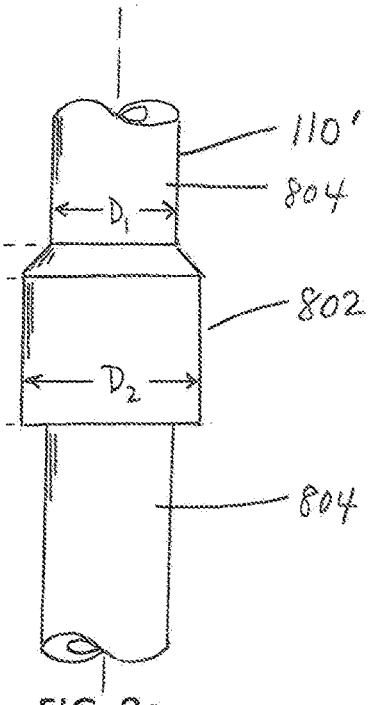

Still referring to FIGS. 8*a* and 8*b*, and now also to 8*c*, the injector 100 can have the capability to handle pipe or tubing 110 with a substantially constant (i.e., nominal) diameter $D_1$, and can also have the capability to handle pipe or tubing having some portions with a nominal diameter $D_1$ and other portions with a secondary diameter $D_2$ that is larger than the nominal diameter. For example, jointed pipe 110' can include so-called upset joint portions 802 where the pipe has an abrupt increase in dimension from a nominal diameter $D_1$ to a secondary, or upset, diameter $D_2$ to allow threaded connection to adjacent pipe sections. As best seen in FIG. 8*c*, the nominal diameter $D_1$ of the jointed pipe 110' increases significantly to the secondary/upset diameter $D_2$ at the upset joint section 802 compared to the standard/nominal diameter portions 804.

In FIGS. 8*a* and 8*b*, the joined pipe injector 100 is shown engaging sections of jointed pipe 110'. For purposes of illustration, the center portion of FIG. 8*a* is enlarged in FIG. 8*b* to better show the configuration of the injector 100 where gripping the upset joint portion 802 of the jointed pipe 110', and FIG. 8*c* shows the subject jointed pipe 110' in isolation from the injector (but with the upset joint portion 802 disposed at the same horizontal location as in FIG. 8*b* as indicated by the broken lines between FIGS. 8*b* and 8*c*).

As best seen in FIG. 8*b*, because each of the pipe inserts 606 in each gripper block assembly 114 is independently spring-biased, the pipe inserts 606' in the localized area adjacent to the upset joint 802 can deflect more (i.e., move further inward into the gripper block channel 616) when contacting the larger diameter $D_2$ of the upset joint, while the remaining pipe inserts 606" can deflect less or have no deflection while remaining in contact against the standard diameter $D_1$ of the remaining (i.e., nominal) portions 804 of the jointed pipe 110'. This feature of localized differential deflection of the pipe inserts 606', 606" while all the pipe inserts continue maintaining an outward bias necessary for gripping is supplied by the independent bias of the springs 602 (i.e., including springs 602' and 602") in each gripper block assembly 114 acting between the respective gripper block bodies 502 and the pipe inserts 606. In the illustrated embodiment, the springs 602' and 602" are nitrogen gas springs, however, other types of springs can used for the springs as previously described.

Although preferred embodiments have been described in detail, it should be understood that various changes, substitutions and alterations can be made therein without departing from the spirit and scope of the invention as defined by the appended claims.

It will be appreciated by those skilled in the art having the benefit of this disclosure that this jointed pipe injector provides a significant improvement over conventional injectors. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A jointed pipe injector for injecting and withdrawing a length of pipe or tubing having a nominal diameter from a wellbore, the jointed pipe injector comprising:

a pair of drive chains, each drive chain configured in an endless loop defining an outward-facing side and including a substantially straight portion, and wherein the outward-facing sides of the substantially straight portions are juxtaposed and spaced apart a first distance to define a pipe/tubing passage therebetween;

a drive mechanism for transporting the drive chains around the respective loops in synchronized fashion wherein both drive chains move along the pipe/tubing passage in a common direction defining a direction of travel and at a common speed; and a plurality of gripper block assemblies mounted on each drive chain, each gripper block assembly including:

a gripper block body connected to a respective one of the drive chains and extending from the outward-facing side thereof;

at least one pipe insert slidingly mounted to an outward-facing side of the gripper block body for sliding movement between a maximum extension and a minimum extension perpendicular to the direction of travel of the respective drive chain; and at least one spring for each pipe insert, the spring operatively connected between the gripper block body and the respective pipe insert and biasing the pipe insert outward toward the maximum extension; and wherein the first distance between the respective outward-facing sides of the drive chains along the pipe/tubing passage is selectively adjustable;

whereby a length of pipe or tubing within the pipe/tubing passage is contacted at nominal portions of the pipe or tubing having a nominal diameter by a first set of the pipe inserts that move a nominal distance from the maximum extension against the bias of the respective springs and at secondary portions of the pipe or tubing having a secondary diameter, which is greater than the nominal diameter, by other sets of the pipe inserts that move a secondary distance, which is greater than the nominal distance, from the maximum extension against the bias of the respective springs of the other sets; and wherein the drive mechanism further comprises a pair of drive assemblies, each of the drive assemblies being slidably mounted on a common frame assembly and carrying one of the pair of drive chains;

a timing mechanism extending between the pair of drive assemblies to synchronize the movement of the drive chains with one another; and a plurality of traction cylinders, the traction cylinders being operable to selectively move the drive assemblies relative to one another on the frame assembly to change the first distance across the pipe/tubing passage; and wherein the timing mechanism further comprises a telescoping torque-tube.

2. The jointed pipe injector in accordance with claim 1, wherein the traction cylinders are connected between the pair of drive assemblies.

3. A jointed pipe injector for injecting and withdrawing a length of pipe or tubing having a nominal diameter from a wellbore, the jointed pipe injector comprising:

a pair of drive chains, each drive chain configured in an endless loop defining an outward-facing side and including a substantially straight portion, and wherein the outward-facing sides of the substantially straight portions are juxtaposed and spaced apart a first distance to define a pipe/tubing passage therebetween;

a drive mechanism for transporting the drive chains around the respective loops in synchronized fashion wherein both drive chains move along the pipe/tubing passage in a common direction defining a direction of travel and at a common speed; and a plurality of gripper block assemblies mounted on each drive chain, each gripper block assembly including:

a gripper block body connected to a respective one of the drive chains and extending from the outward-facing side thereof;

at least one pipe insert slidingly mounted to an outward-facing side of the gripper block body for sliding movement between a maximum extension and a minimum extension perpendicular to the direction of travel of the respective drive chain; and at least one spring for each pipe insert, the spring operatively connected between the gripper block body and the respective pipe insert and biasing the pipe insert outward toward the maximum extension; and wherein the first distance between the respective outward-facing sides of the drive chains along the pipe/tubing passage is selectively adjustable;

whereby a length of pipe or tubing within the pipe/tubing passage is contacted at nominal portions of the pipe or tubing having a nominal diameter by a first set of the pipe inserts that move a nominal distance from the maximum extension against the bias of the respective springs and at secondary portions of the pipe or tubing having a secondary diameter, which is greater than the nominal diameter, by other sets of the pipe inserts that move a secondary distance, which is greater than the nominal distance, from the maximum extension against the bias of the respective springs of the other sets; and wherein the drive mechanism further comprises a pair of drive assemblies, each of the drive assemblies being slidably mounted on a common frame assembly and carrying one of the pair of drive chains;

a timing mechanism extending between the pair of drive assemblies to synchronize the movement of the drive chains with one another; and a plurality of traction cylinders, the traction cylinders being operable to selectively move the drive assemblies relative to one another on the frame assembly to change the first distance across the pipe/tubing passage; and the jointed pipe injector further comprising a skate assembly mounted on each drive assembly, wherein each skate assembly includes:

a skate body mounted inside the respective loop of drive chain along the substantially straight portion;

a plurality of skate rollers rotatably mounted on the skate body in successive rows along the direction of travel to collectively form a substantially flat surface adjacent an inward side of the respective drive chain.

4. The jointed pipe injector in accordance with claim 3, wherein each gripper block assembly further include a slide plate connected to the gripper block body and disposed on the inward-facing side of the respective drive chain that rolls over the skate rollers of the skate assembly along the substantially straight portion of the loop.

5. The jointed pipe injector in accordance with claim 4, wherein the slide plate include interleaved portions that simultaneously roll over at least two successive rows of the skate rollers and interfit with the interleaved portions of adjacent slide plates.

6. A jointed pipe injector for injecting and withdrawing a length of pipe or tubing having a nominal diameter from a wellbore, the jointed pipe injector comprising:

a pair of drive chains, each drive chain configured in an endless loop defining an outward-facing side and including a substantially straight portion, and wherein the outward-facing sides of the substantially straight portions are juxtaposed and spaced apart a first distance to define a pipe/tubing passage therebetween;

a drive mechanism for transporting the drive chains around the respective loops in synchronized fashion wherein both drive chains move along the pipe/tubing passage in a common direction defining a direction of travel and at a common speed; and a plurality of gripper block assemblies mounted on each drive chain, each gripper block assembly including:

a gripper block body connected to a respective one of the drive chains and extending from the outward-facing side thereof;

at least one pipe insert slidingly mounted to an outward-facing side of the gripper block body for sliding movement between a maximum extension and a minimum extension perpendicular to the direction of travel of the respective drive chain; and at least one spring for each pipe insert, the spring operatively connected between the gripper block body and the respective pipe insert and biasing the pipe insert outward toward the maximum extension; and wherein the first distance between the respective outward-facing sides of the drive chains along the pipe/tubing passage is selectively adjustable;

whereby a length of pipe or tubing within the pipe/tubing passage is contacted at nominal portions of the pipe or tubing having a nominal diameter by a first set of the pipe inserts that move a nominal distance from the maximum extension against the bias of the respective springs and at secondary portions of the pipe or tubing having a secondary diameter, which is greater than the nominal diameter, by other sets of the pipe inserts that move a secondary distance, which is greater than the nominal distance, from the maximum extension against the bias of the respective springs of the other sets; and wherein the drive mechanism further comprises a pair of drive assemblies, each of the drive assemblies being slidably mounted on a common frame assembly and carrying one of the pair of drive chains;

a timing mechanism extending between the pair of drive assemblies to synchronize the movement of the drive chains with one another; and a plurality of traction cylinders, the traction cylinders being operable to selectively move the drive assemblies relative to one another on the frame assembly to change the first distance across the pipe/tubing passage; and wherein:

each drive assembly further comprises sprockets guiding the drive chain at each end of the pipe/tubing path, whereby motion of the gripper block assemblies attached to the drive chain transitions from curving motion to straight-line motion as the gripper block assemblies travel from the sprockets to the substantially straight portion; and wherein the injector further comprises an insert guide positioned between drive assemblies and configured to engage the pipe inserts entering the pipe gap to push the pipe inserts inward into the gripper block at the end of the pipe/tubing path to apply a pre-compression to the pipe inserts against the bias of the springs of the gripper block assemblies traveling in curving motion prior to those pipe inserts contacting the pipe/tubing and to release the pre-compression when the respective gripper block assemblies are moving in straight-line motion.

7. The jointed pipe injector in accordance with claim 6 wherein the insert guide has a double taper configuration including a first tapered portion forming a first angle with a centerline of the pipe/tubing passage, a second tapered portion forming a second angle with the centerline of the pipe/tubing passage, and a dwell portion disposed between the first and second tapered portions.

8. A jointed pipe injector for injecting and withdrawing a length of pipe or tubing having a nominal diameter from a wellbore, the jointed pipe injector comprising:

a pair of drive chains, each drive chain configured in an endless loop defining an outward-facing side and including a substantially straight portion, and wherein the outward-facing sides of the substantially straight portions are juxtaposed and spaced apart a first distance to define a pipe/tubing passage therebetween;

a drive mechanism for transporting the drive chains around the respective loops in synchronized fashion wherein both drive chains move along the pipe/tubing passage in a common direction defining a direction of travel and at a common speed; and a plurality of gripper block assemblies mounted on each drive chain, each gripper block assembly including:

a gripper block body connected to a respective one of the drive chains and extending from the outward-facing side thereof;

at least one pipe insert slidingly mounted to an outward-facing side of the gripper block body for sliding movement between a maximum extension and a minimum extension perpendicular to the direction of travel of the respective drive chain; and at least one spring for each pipe insert, the spring operatively connected between the gripper block body and the respective pipe insert and biasing the pipe insert outward toward the maximum extension; and wherein the first distance between the respective outward-facing sides of the drive chains along the pipe/tubing passage is selectively adjustable;

whereby a length of pipe or tubing within the pipe/tubing passage is contacted at nominal portions of the pipe or tubing having a nominal diameter by a first set of the pipe inserts that move a nominal distance from the maximum extension against the bias of the respective springs and at secondary portions of the pipe or tubing having a secondary diameter, which is greater than the nominal diameter, by other sets of the pipe inserts that move a secondary distance, which is greater than the nominal distance, from the maximum extension against the bias of the respective springs of the other sets; and wherein the springs comprise nitrogen gas springs.

9. The jointed pipe injector in accordance with claim 8, wherein the gripper block assemblies are removably attached by bolts to the drive chains.

10. A gripper block assembly for a jointed pipe injector having a drive chain including a plurality of interconnected links defining a direction of travel of the drive chain, the gripper block assembly comprising:

a gripper block body having an inward side and an outward side, the outward side being configured to define at least one insert channel having a channel axis;

a slide plate having an outward side, wherein the inward side of the gripper block body is mountable on a first side of at least one of a plurality of interconnected links of a drive chain and the outward side of the slide plate is mountable on a second side of the same at least one of the plurality of interconnected links, whereby when so mounted the gripper block body, the slide plate and the at least one of the plurality of interconnected links move as a unit and the insert channel axis is oriented perpendicular to a direction of travel of the drive chain;

at least one pipe insert including an insert body portion and a gripper portion, wherein the insert body portion is slidingly mounted in the insert channel to be moveable between a maximum extension and a minimum extension along the insert channel axis and the gripper portion faces outward from the insert body portion; and at least one spring corresponding, respectively, to each pipe insert, each spring having a fixed end portion and a moving end portion, wherein the moving end portion is biased away from the fixed end portion, and wherein the fixed end portion of each spring is operatively connected to the gripper block body and the moving end portion of the spring is operatively connected to the respective pipe insert to bias the respective pipe insert toward the maximum extension along the insert channel axis;

wherein:

each of the at least one pipe insert further comprises a pair of lateral arm portions extending away from the gripper portion in lateral directions substantially perpendicular to both the insert channel axis and the direction of travel;

the at least one spring corresponding to each pipe insert further comprises at least one spring disposed between the gripper block body and each respective lateral arm portion of each respective pipe insert; and each lateral arm portion is biased independently of the other lateral arm portion by the respective at least one spring disposed under the respective lateral arm portion.

11. The gripper block assembly in accordance with claim 10, wherein at least one of the inward side of the gripper block body and the outward side of the slide plate is configured to interfit against the at least one of the plurality of interconnected links to transmit traction force from the drive chain to the gripper block assembly in the direction of travel when the gripper block body is connected to the slide plate across the at least one of the plurality of interconnected links.

12. The gripper block assembly in accordance with claim 11, wherein the gripper block body and the slide plate are configured for removable connection of the gripper block body to the slide plate on opposite sides of the at least one of the plurality of interconnected links using bolts.

13. The gripper block assembly in accordance with claim 11, wherein the inward side of the gripper block body and the outward side of the slide plate are configured to interfit against a single link of the drive chain.

14. The gripper block assembly in accordance with claim 10, wherein the gripper block body defines at least two insert channels, and at least one pipe insert is slidingly mounted in each of the at least two insert channels.

15. The gripper block assembly in accordance with claim 10, wherein each of the at least one pipe inserts further comprises:

a multi-radius gripping surface having a plurality of curved portions including a first curved portion and second curved portion;

the first curved portion curving with a first radius around a first center; and the second curved portion curving with a second radius around a second center; and wherein the second radius has a different length from the first radius; and wherein the locations of the first and second centers are not coincident.

16. The gripper block assembly in accordance with claim 10, wherein:

the gripper block body defines two laterally extending insert channels configured parallel to one another;

one pipe insert is slidingly mounted in each insert channel;

the lateral arm portions each pipe insert extend laterally past each end of the respective insert channel; and one spring is disposed laterally adjacent to each end of each insert channel to bias the respective lateral arm portion toward the maximum extension.

17. A gripper block assembly for a jointed pipe injector having a drive chain including a plurality of interconnected links defining a direction of travel of the drive chain, the gripper block assembly comprising:

a gripper block body having an inward side and an outward side, the outward side being configured to define at least one insert channel having a channel axis;

a slide plate having an outward side, wherein the inward side of the gripper block body is mountable on a first side of at least one of a plurality of interconnected links of a drive chain and the outward side of the slide plate is mountable on a second side of the same at least one of the plurality of interconnected links, whereby when so mounted the gripper block body, the slide plate and the at least one of the plurality of interconnected links move as a unit and the insert channel axis is oriented perpendicular to a direction of travel of the drive chain;

at least one pipe insert including an insert body portion and a gripper portion, wherein the insert body portion is slidingly mounted in the insert channel to be moveable between a maximum extension and a minimum extension along the insert channel axis and the gripper portion faces outward from the insert body portion; and at least one spring corresponding, respectively, to each pipe insert, each spring having a fixed end portion and a moving end portion, wherein the moving end portion is biased away from the fixed end portion, and wherein the fixed end portion of each spring is operatively connected to the gripper block body and the moving end portion of the spring is operatively connected to the respective pipe insert to bias the respective pipe insert toward the maximum extension along the insert channel axis; and wherein the springs comprise nitrogen gas springs.

* * * * *